US007246888B2

(12) United States Patent
Akahane et al.

(10) Patent No.: US 7,246,888 B2
(45) Date of Patent: Jul. 24, 2007

(54) LIQUID JETTING HEAD AND METHOD OF MANUFACTURING THE SAME

(75) Inventors: Fujio Akahane, Nagano (JP); Ryoji Uesugi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 914 days.

(21) Appl. No.: 10/329,748

(22) Filed: Dec. 27, 2002

(65) Prior Publication Data

US 2003/0121995 A1 Jul. 3, 2003

(30) Foreign Application Priority Data

Dec. 27, 2001 (JP) ..... P2001-396067
Apr. 4, 2002 (JP) ..... P2002-102950
Jun. 28, 2002 (JP) ..... P2002-190562

(51) Int. Cl.
*B41J 2/045* (2006.01)
*B41J 2/015* (2006.01)

(52) U.S. Cl. ..... 347/71; 347/70; 347/20

(58) Field of Classification Search ..... 347/20, 347/40, 44, 56, 61, 68, 70, 71, 72
See application file for complete search history.

(56) References Cited

U.S. PATENT DOCUMENTS

| | | | |
|---|---|---|---|
| 5,880,763 | A | 3/1999 | Tanaka et al. |
| 5,895,313 | A | 4/1999 | Ikezaki et al. |
| 6,095,640 | A | 8/2000 | Ishinaga et al. |
| 6,305,782 | B1 | 10/2001 | Kishima et al. |

FOREIGN PATENT DOCUMENTS

| | | | |
|---|---|---|---|
| EP | 0 755 791 | A2 | 1/1997 |
| EP | 0 787 589 | A2 | 8/1997 |
| EP | 0 830 945 | A | 3/1998 |
| EP | 1 020 292 | A | 7/2000 |
| EP | 1 024 005 | A | 8/2000 |
| EP | 1 245 853 | A1 | 8/2000 |
| EP | 1 116 588 | A1 | 7/2001 |
| EP | 1 118 466 | A | 7/2001 |
| EP | 1 231 061 | A1 | 8/2002 |
| JP | 55-14283 | | 1/1980 |
| JP | 57-208250 | A | 12/1982 |
| JP | 61-242852 | A | 10/1986 |
| JP | 5-177834 | A | 7/1993 |
| JP | 5-330042 | | 12/1993 |

(Continued)

*Primary Examiner*—Shih-Wen Hsieh
(74) *Attorney, Agent, or Firm*—Sughrue Mion, PLLC

(57) ABSTRACT

A liquid jetting head includes a nozzle plate, a liquid passage plate and a sealing plate. The nozzle plate is provided with a plurality of nozzle orifices. The liquid passage plate has a first face and a second face which are opposite to each other. The liquid passage plate is provided with a plurality of grooves which are arranged in a first direction perpendicular to a longitudinal direction of the groove on the first face, each groove having a communication port which passes through from the first face to the second face. The sealing plate for sealing opening faces of the grooves. The sealing plate is jointed to the first face so that a plurality of pressure generating chambers are formed. The nozzle plate is jointed to the second face such that the communication holes are communicated with the nozzle orifices respectively.

13 Claims, 13 Drawing Sheets

FOREIGN PATENT DOCUMENTS

| | | | |
|---|---|---|---|
| JP | 6-91883 | A | 4/1994 |
| JP | 6-191043 | A | 7/1994 |
| JP | 6-238896 | | 8/1994 |
| JP | 7-156396 | A | 6/1995 |
| JP | 7-246706 | | 9/1995 |
| JP | 8-267753 | A | 10/1996 |
| JP | 2000-190494 | | 7/2000 |
| JP | 2000-263799 | | 9/2000 |
| JP | 2001010040 | A | 1/2001 |
| WO | WO 01/10646 | A1 | 2/2001 |

LIQUID JETTING HEAD AND METHOD OF MANUFACTURING THE SAME

BACKGROUND OF THE INVENTION

The present invention relates to a liquid jetting head of a liquid jetting device, for example, a liquid jetting head such as an ink jet recording head employed in an image recording equipment such as a printer, etc., a coloring material jetting head employed to manufacture a color filter such as a liquid crystal display, etc., an electrode material jetting head employed to form electrodes of an organic EL (Electro Luminescence) display, FED (face emission display), etc., a bioorganic substance jetting head employed to manufacture a biochip (biochemical element), or the like, and a method of manufacturing the same.

The liquid jetting head has a series of channels, which are extended from a common liquid chamber to nozzle orifices via pressure generating chambers, in plural as many as the nozzle orifices. Then, in reply to the request for the higher density, respective pressure generating chambers must be formed at a fine pitch that corresponds to the density (the number of impacts of liquid droplets per unit area). Therefore, a thickness of bulkhead portions that partition adjacent pressure generating chambers becomes very thin. Also, in order to use effectively a liquid pressure in the pressure generating chambers to eject the droplet, a channel width of liquid supply ports that communicate the pressure generating chambers with a common liquid chamber is narrowed much more than a chamber width of the pressure generating chambers.

From a viewpoint of manufacturing the pressure generating chambers and the liquid supply ports, both have a fine shape, with good precision, a silicon substrate is preferably employed in the liquid jetting head, e.g., the ink jet recording head in the related art. In other words, crystal faces of the silicon substrate are exposed by the anisotropic etching, and then the pressure generating chambers and the liquid supply ports are partitioned and formed by the crystal faces.

Also, a nozzle plate in which the nozzle orifices are formed is comprised of a metal plate to satisfy the request for the workability, etc. Then, a diaphragm portion that changes volumes of the pressure generating chambers is formed in an elastic plate. This elastic plate has a double-layered structure in which a resin film is laminated on a metal supporting plate, and is fabricated by removing the supporting plate at portions that correspond to the pressure generating chambers.

Meanwhile, in the above liquid jetting head in the related art, the silicon substrate as the material is supplied as the wafer in a regular shape. Thus, the number of silicon members of the liquid jetting head, which can be fabricated from a sheet of this wafer, is limited. In other words, for example, the number of the silicon members that can be processed simultaneously by one step such as the anisotropic etching, or the like is limited. Therefore, there are problems such that above steps are disadvantageous in cost and working efficiency when the heads are to be mass-produced, and also response to the increase in size of the liquid jetting head is difficult. Also, because the solvent is employed in the etching of the silicon members, the waste liquid processing of the solvent must be sufficiently considered from a viewpoint of the environmental protection. Thus, there is such a problem that a higher cost is needed correspondingly.

Also, considerable difference in the coefficient of linear expansion exists between the silicon and the metal. Hence, when respective members of the silicon substrate, the nozzle plate, and the elastic plate are to be pasted together, such members must be adhered at a relatively low temperature while spending long time. Therefore, it is difficult to achieve improvement of the productivity, which serves as one factor to increase a production cost.

In addition, a thickness of the bulkhead portions that partition adjacent pressure generating chambers is very small and thus their rigidity is small. Therefore, there is a so-called adjacent crosstalk problem such that the ejection characteristic of the droplet is varied by the influence of the liquid pressure that is generated in the adjacent pressure generating chamber.

Also, the trial to form the pressure generating chambers in the metal substrate by the plastic working is being carried out. In this case, since the pressure generating chambers are very fine and a channel width of the liquid supply ports must be formed narrower than a chamber width of the pressure generating chambers, etc., such working is difficult. In addition, since a high precision is required of the male mold that is employed to form the pressure generating chambers and the liquid supply ports, manufacture of the male mold is difficult. Therefore, there is such a problem that it is difficult to improve the production efficiency.

SUMMARY OF THE INVENTION

It is therefore an object of the present invention to provide a liquid jetting head and a method of manufacturing the same being capable of reducing a production cost, achieving a working efficiency, and adapting to an increase in size of the liquid jetting head. Further, The liquid jetting head and the method being capable of preventing the adjacent crosstalk by increasing a rigidity of a bulkhead portion, and forming pressure generating chambers by the press working with fine precision with respect to a metal substrate and facilitating the production of a male mold with fine precision.

In order to achieve the above object, according to the present invention, there is provided a liquid jetting head comprising:

a nozzle plate, provided with a plurality of nozzle orifices;

a liquid passage plate, having a first face and a second face which are opposite to each other, and provided with a plurality of grooves which are arranged in a first direction perpendicular to a longitudinal direction of the groove on the first face, each groove having a communication port which passes through from the first face to the second face; and a sealing plate for sealing opening faces of the grooves, wherein the sealing plate is jointed to the first face so that a plurality of pressure generating chambers are formed; and wherein the nozzle plate is jointed to the second face such that the communication holes are communicated with the nozzle orifices respectively.

Preferably, a thickness of root portions of bulkhead portions, which partition adjacent pressure generating chambers, is formed thicker than a thickness of top end portions thereof.

Here it is preferable that, bottom faces of the grooves are recessed in a V-shape.

Here it is preferable that, bottom faces of the grooves are recessed in a circular arc.

Preferably, both end portions of the grooves in the longitudinal direction are chamfered.

Preferably, each communication port includes a first communication port formed to the middle of the liquid passage plate in a plate thickness direction from the first face, and a second communication port formed from a bottom face of the first communication port to the second face, and an inner dimension of the second communication port is smaller than that of the first communication port.

Preferably, the sealing plate has liquid supply ports communicated with the pressure generating chambers respectively such that liquid flows from a common liquid chamber to the pressure generating chambers via the liquid supply ports.

Preferably, the liquid passage plate is comprised of metal.

Preferably, the opening shapes of the grooves are shaped into a rectangle, and opening shapes of the communication ports are shaped into a rectangle.

Preferably, at least a part of each communication port is overlapped with one end portion of each groove, each communication port is positioned into a range of a width of each groove.

Here it is preferable that, each communication port is wholly included in each groove.

Here it is preferable that, at least a part of each communication port is overlapped with each groove, and other portion thereof is positioned on an outside of each groove.

Preferably, the liquid passage plate is comprised of laminated material formed by superposing a plurality of plate materials.

Preferably, the liquid passage plate is comprised of coating plate material in which a metal substrate is coated by resin.

Preferably, the nozzle plate is comprised of metal material, and the sealing plate is comprised of metal material.

In this case, the "metal material" is used as a concept that contains a composite material, in which an elastic film is laminated on a surface of metal, in addition to a metal single body.

Preferably, a diaphragm portion having elasticity is formed in a sealing area of the sealing plate for sealing the grooves, and the diaphragm portion is deformed by a piezoelectric vibrator to apply pressure to liquid in the pressure generating chambers.

Preferably, liquid in the pressure generating chambers is applied a pressure by bubbles that are generated by heat generating elements arranged in the pressure generating chambers.

Preferably, dummy pressure generating chambers that have no connection with ejection of a droplet are provided next to both end of the pressure generating chambers arranged in a first direction respectively.

Here it is preferable that, a width of the dummy pressure generating chambers in the first direction is wider than a width of the pressure generating chambers.

Preferably, the liquid jetting head further comprising a case having a joint face, the joint face provided with a concave portion, and the case is jointed to the sealing plate so that a common liquid chamber communicated with the pressure generating chambers is formed by the concave portion and the sealing plate.

According to the present invention, there is also provided a method of manufacturing a liquid jetting head comprising the steps of:

providing a metal plate having a first face and a second face which are opposite to each other;

providing a first mold having a plurality of ridge portions, a top end of each ridge portion being tapered away;

providing a second mold having a plurality of first poles;

providing a sealing plate;

providing a nozzle plate having a plurality of nozzle orifices;

pushing the ridge portions of the first mold into the metal plate to the middle in a thickness of the metal plate such that grooves are provided on the first face of the metal plate;

pushing the first poles of the second mold into the metal plate so as to form communication ports on the grooves respectively, each communication port passing through from the first face to the second face;

jointing the sealing plate to the first face of the liquid passage plate so that a plurality of pressure generating chambers are formed; and jointing the nozzle plate to the second face of the liquid passage plate so that the communication holes are communicated with the nozzle orifices respectively.

Preferably, the ridge portions are arranged in a direction perpendicular to a longitudinal direction thereof, and all grooves on the metal plate are formed by the single pushing operation of the ridge portions.

Preferably, the ridge portions are arranged in a direction perpendicular to a longitudinal direction thereof, and all grooves on the metal plate are formed by the pushing operation of the corresponding ridge portions in which the ridge portions same number as the all grooves push in the metal plate a plurality of times so as to gradually form the grooves deep.

Here it is preferable that, the first mold is formed by applying a grooving to a metal block so as to form recesses between the ridge portions.

Preferably, top ends of the ridge portions are shaped into a V-shape.

Preferably, top ends of the ridge portions are shaped into a circular arc.

Here it is preferable that, the shape of the top ends of the ridge portions are formed by polishing.

Preferably, the method further comprising the steps of: providing a third mold having a plurality of second poles, in which a diameter of the second poles is larger than that of the first poles, and pushing the second poles of the third mold into the metal plate to the middle of the metal plate in a plate thickness direction from the first face side so as to form second communication ports in the metal plate, each second communication port being communicated with each groove before the first pole pushing step is performed, and the first poles are pushed into the metal plate from a bottom face of the second communication port to the second face.

Here it is preferable that, the first poles are arranged in line, and the second poles are arranged in line.

Here it is preferable that, the second mold is formed by applying a grooving to a block material so as to form recesses between the first poles.

Here it is preferable that, the third mold is formed by applying a grooving to a block material so as to form recesses between the second poles.

Preferably, both the ridge portion pushing step and the first pole pushing step are performed in a same stage in a sequential feeding mold.

Preferably the method further comprising the step of polishing the first face and the second face of the metal plate to planarize the faces after the first pole pushing step is performed.

Preferably, the metal plate is comprised of nickel.

In the above configurations and methods, the liquid passage plate can be formed not to employ the etching. Therefore, a production cost can be suppressed and also a working efficiency can be improved. Also, the present invention can respond to increase in size of the liquid injection head.

Also, the coefficients of linear expansion of the liquid passage plate, the nozzle plate, and the sealing plate can be set uniformly. Therefore, jointing of these members can be executed at the high temperature. As a result, the jointing of these members can be completed in a short time and also improvement in the manufacturing efficiency can be achieved.

Also, the grooves whose bottom face is recessed like the V-shape or the circular-arc-shape are aligned in the liquid passage plate, and the communication ports that penetrate the plate thickness direction are formed in one end portions of the grooves. Therefore, the grooves and the communication ports can be fabricated by the press working with good dimensional precision.

Since the root portions of the bulkhead portions that partition the pressure generating chambers are formed thicker than the top end portions thereof, the rigidity of the bulkhead portions can be enhanced. Therefore, the bulkhead portions are hardly affected by the pressure of the liquid in the adjacent pressure generating chambers. As a result, the so-called adjacent crosstalk can be prevented and thus the injection characteristic of the droplet can be improved.

Also, if the liquid supply ports that communicate the pressure generating chambers with the common liquid chamber are provided to pass through the sealing plate, the very fine diameter can be fabricated with good dimensional precision. Therefore, the channel resistance between the pressure generating chambers and the common liquid chamber can be defined with high precision, the injection characteristic of the droplet can be stabilized.

Also, the communication ports consist of the first communication ports formed in the liquid passage plate up to the half way of the plate thickness direction from the groove side, and the second communication ports formed to pass through the plate thickness direction from the bottom faces of the first communication ports. Then, if inner diameters of the second communication ports are set smaller than inner diameters of the first communication ports, the second communication ports can be formed after the first communication ports are formed. Thus, the very fine communication ports can be fabricated with good dimensional precision.

Also, if the dummy pressure generating chambers that have no connection with the injection of the droplet are formed next to the pressure generating chambers located on both end portion of the alignment, the pressure generating chamber is formed on one side of the pressure generating chamber located at the end portion of the alignment and the dummy pressure generating chamber is formed on the other side thereof. Therefore, the rigidity of the bulkheads between the pressure generating chambers located at the end portion of the alignment and the pressure generating chambers located in the middle of the alignment can be made uniform, and thus the injection characteristic of the droplet can be set uniformly.

Also, if a width of the dummy pressure generating chambers in the alignment direction is set wider than a width of the pressure generating chambers, the injection characteristics of the pressure generating chambers located at the end portion and the pressure generating chambers located in the middle of the alignment can be made uniform with high precision.

Also, if the top end concave portion is formed by depressing partially the top end face of the case and also the common liquid chamber is formed by the top end concave portion and the sealing plate, the dedicated member used to form the common liquid chamber can be neglected and also simplification of the structure can be achieved.

Also, if the molds of the grooves and the communication ports (first communication ports, second communication ports) are formed by two steps of the grooving and the polishing, such male molds can be worked with good precision and easily.

BRIEF DESCRIPTION OF THE DRAWINGS

The above objects and advantages of the present invention will become more apparent by describing in detail preferred exemplary embodiments thereof with reference to the accompanying drawings, wherein:

FIG. 5 shows explanatory views of the pressure generating chamber forming plate.

FIG. 7 shows Explanatory views of the elastic plate.

DETAILED DESCRIPTION OF THE PREFERRED EMBODIMENTS

Embodiments of the present invention will be explained with reference to the drawings hereinafter.

Figure 1:
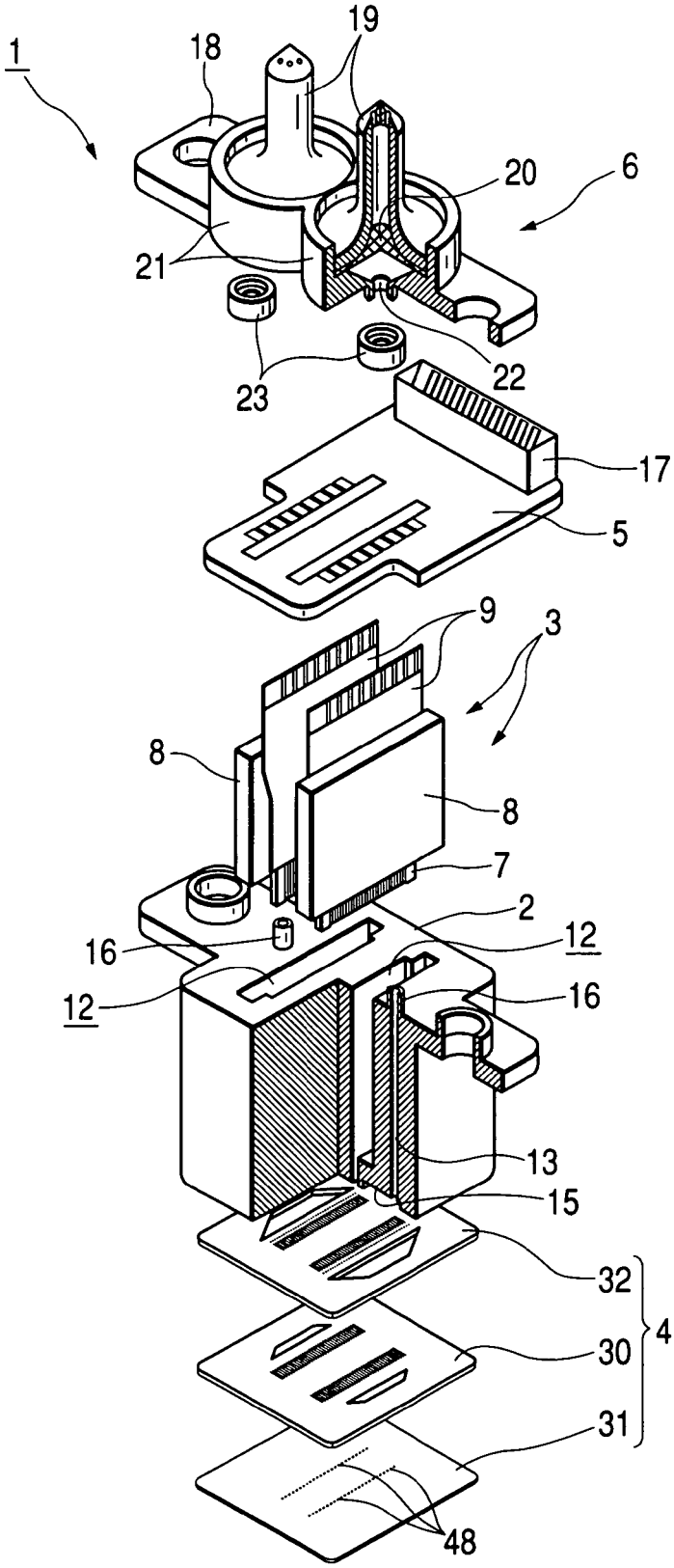
FIG. 1 shows an exploded perspective view of a recording head.
Figure 2:
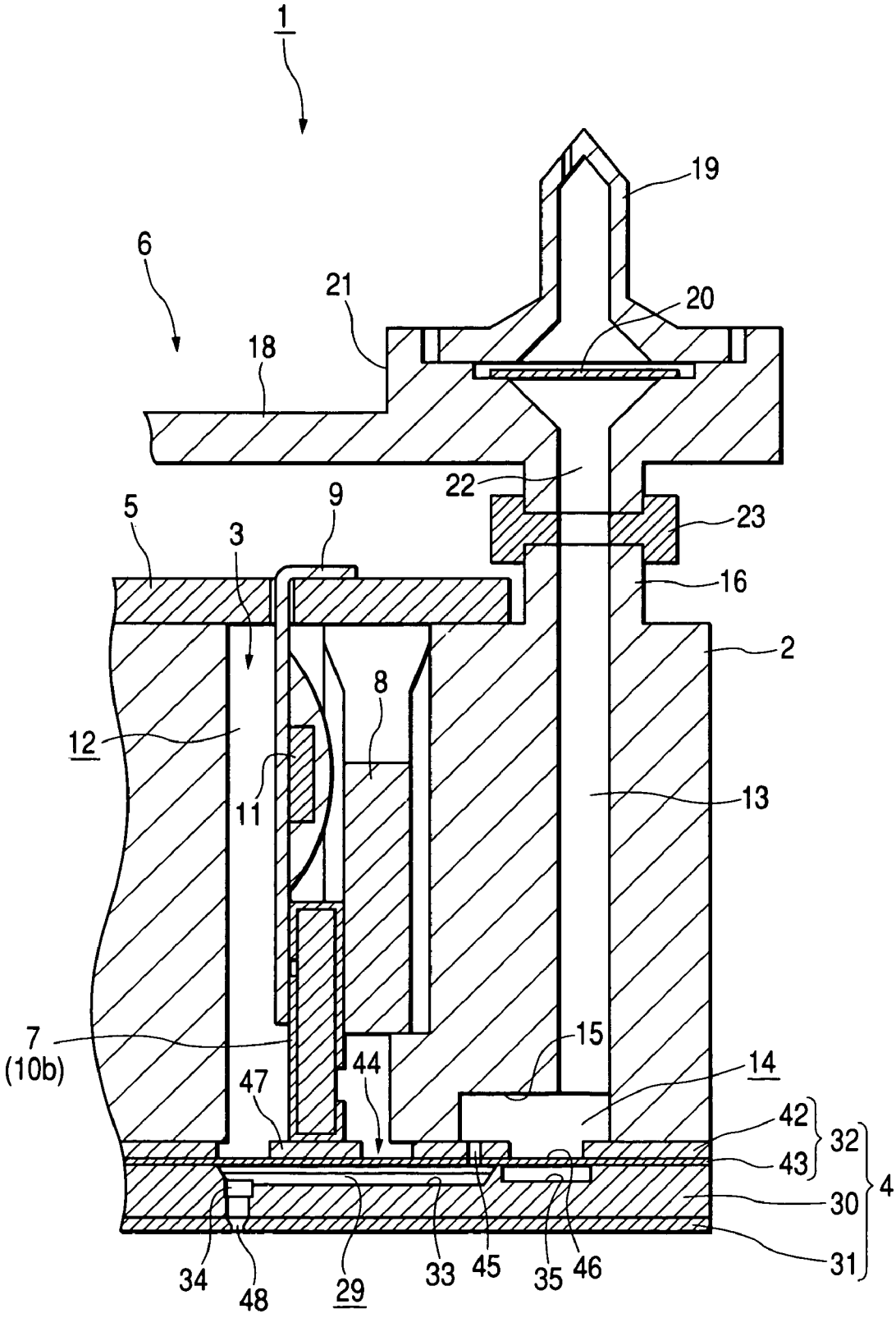
FIG. 2 shows a sectional view of the recording head.

As shown in FIGS. 1 and 2, an ink jet recording head (referred simply to as a "recording head" hereinafter) 1 as one type of a liquid jetting head of the present invention is employed to eject the ink and record the image, etc. This recording head 1 includes a case 2, a vibrator unit 3 housed in this case 2, a channel unit 4 jointed to a top face of the case 2, a connection substrate 5 arranged on a fitting face of the case 2 on the opposite side to the top face, a supply needle unit 6 fitted to the fitting face side of the case 2, etc. In this case, the above ink is a liquid ink, and is one type of the liquid in the present invention.

Figure 3A:
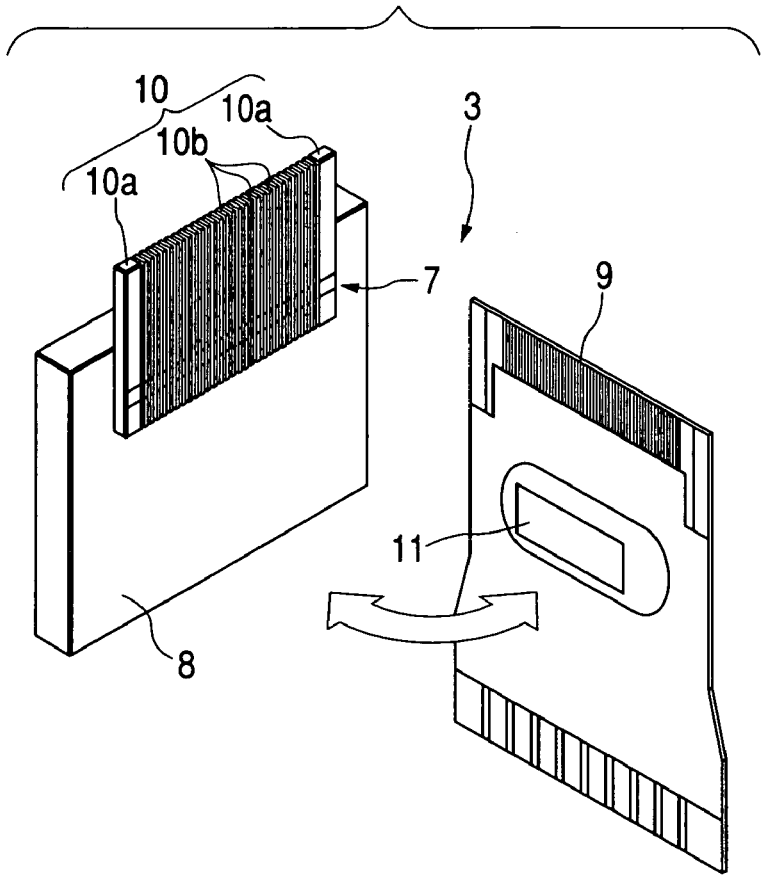
FIGS. 3A and 3B show views explaining a vibrator unit.
Figure 3B:
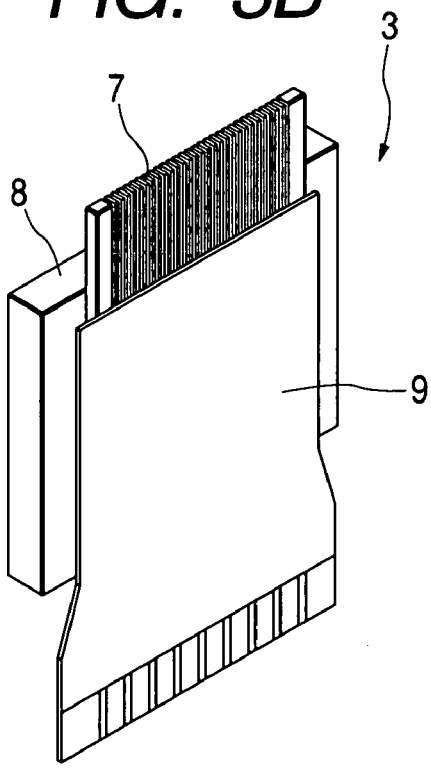

As shown in FIG. 3, the above vibrator unit 3 includes piezoelectric vibrator groups 7, fixing plates 8 to which the piezoelectric vibrator groups 7 are jointed, and flexible cables 9 for supplying driving signals to the piezoelectric vibrator groups 7.

The piezoelectric vibrator group 7 has a plurality of piezoelectric vibrators 10 that are formed like the column. Each piezoelectric vibrator 10 is one type of a pressure generating element of the present invention and also one type of an electromechanical transducer element. Each of these piezoelectric vibrators 10 consists of a pair of dummy vibrators 10*a* positioned at both ends of the column, and a plurality of driving vibrators 10*b* arranged between these dummy vibrators 10*a*. Then, the driving vibrators 10*b* are separated like the teeth of a comb, each of which has a very narrow width of about 50 μm to 100 μm, for example, and 180 driving vibrators are provided.

Also, the dummy vibrator 10*a* has a width that is wider than the driving vibrator 10*b*, and has a protecting function of protecting the driving vibrators 10*b* from the impact, etc. and a guiding function of positioning the vibrator unit 3 at a predetermined position.

A free end portion of each piezoelectric vibrator 10 is protruded to the outside from the top face of the fixing plate 8 by jointing a fixed end portion to the fixing plate 8. In other words, each piezoelectric vibrator 10 is supported onto the fixing plate 8 in the so-called cantilever state. Then, the free end portion of each piezoelectric vibrator 10 is constructed by laminating a piezoelectric substance and an inner electrode alternatively, and is expanded and contracted in the longitudinal direction of the element if potential difference is applied between opposing electrodes.

The flexible cable 9 is electrically connected to the piezoelectric vibrator 10 on the side face of the fixed end portion, which is the opposite side to the fixing plate 8. Then, a control IC 11 for controlling the drive of the piezoelectric vibrator 10, etc. is mounted on a surface of the flexible cable 9. Also, the fixing plate 8 for supporting each piezoelectric vibrator 10 is provided as a plate member that has the rigidity enough to receive the reaction from the piezoelectric vibrator 10. Preferably the metal plate such as a stainless plate, or the like should be employed.

The above case 2 is a block-like member that is molded out of thermosetting resin such as epoxy resin, or the like, for example. Here, the reason why the case 2 is molded out of thermosetting resin is that such thermosetting resin has a mechanical strength higher than the normal resin and that, since a coefficient of linear expansion is smaller than the normal resin, the deformation due to change in the ambient temperature is small. Then, a housing space 12, in which the vibrator unit 3 can be housed, and a liquid supply path 13, which constitutes a part of the channel of the liquid, are formed in the inside of the case 2. Also, a concave portion 15 serving as a common ink chamber (common liquid chamber of the present invention) 14 is formed at the top face of the case 2.

The housing space 12 is a space that has a size that can house the vibrator unit 3 therein. A case inner wall of the top end side portion of the housing space 12 is protruded partially toward the side such that an upper face of this protruded portion can function as a fixing plate contact face. Then, the vibrator unit 3 is housed in the housing space 12 in the situation that a top end of each piezoelectric vibrator 10 faces to the opening. In this housed situation, a top face of the fixing plate 8 is adhered to contact to the fixing plate contact face.

The concave portion 15 is manufactured by depressing partially the top face of the case 2. The concave portion 15 in the present embodiment is an almost trapezoidal concave portion that is formed on the left and right sides positioned outer than the housing space 12, and is formed such that a bottom side of the trapezoid is positioned on the side of the housing space 12.

The ink supply path 13 is formed to pass through the case 2 along the height direction, and its top end is communicated with the concave portion 15. Also, an end portion of the ink supply path 13 on the fitting face side is formed in a connection port 16 that is projected from the fitting face.

The above connection substrate 5 is a wiring substrate on which electrical wirings for various signals, which are supplied to the recording head 1, are formed and to which a connector 17, to which a signal cable can be connected, is fitted. Then, this connection substrate 5 is arranged on the fitting face of the case 2, and the electrical wirings of the flexible cable 9 are connected thereto by the soldering, or the like. Also, a end portion of the signal cable extended from a control unit (not shown) is inserted into the connector 17.

The above supply needle unit 6 is a portion to which an ink cartridge (not shown) is connected, and is schematically composed of a needle holder 18, ink supply needles 19, and filters 20.

The ink supply needle 19 is a portion that is inserted into the ink cartridge, and introduces the ink that is stored in the ink cartridge. A top end portion of the ink supply needle 19 is sharpened like a circular cone such that the top end portion can be easily inserted into the ink cartridge. Also, a plurality of ink introducing holes that communicate the inside of the ink supply needle 19 with the outside are cut through in this top end portion. Then, since the recording head 1 of the present embodiment can eject two types of inks, two ink supply needles 19 are provided.

The needle holder 18 is a member to which the ink supply needles 19 are fitted. Two pedestals 21 that fix a root portion of the ink supply needle 19 respectively are formed in parallel on its surface. The pedestal 21 is formed like a circle to coincide with a bottom shape of the ink supply needle 19. Also, an ink exhaust port 22 that penetrates the needle holder 18 in the plate thickness direction is formed at the almost center of the bottom face of the trapezoid. Also, the needle holder 18 is extended toward the side of the flange portion.

The filter 20 is a member that prevents the foreign matters in the ink such as dust, flash in the molding, etc. from passing, and is constructed by a metal net of fine meshes, for example. This filter 20 is adhered to a filter holding recess formed in the pedestal 21. Then, as shown in FIG. 2, the supply needle unit 6 is arranged on the fitting face of the case 2. In this arrangement state, the ink exhaust port 22 of the supply needle unit 6 and the connection port 16 of the case 2 are communicated with each other via a packing 23 in a watertight state.

Next, the above channel unit 4 will be explained hereunder. This channel unit 4 has a structure that is constructed by jointing a nozzle plate 31 to one face of a pressure generating chamber forming plate 30 and jointing a sealing plate (elastic plate) 32 to the other face of the pressure generating chamber forming plate 30.

Figure 4:
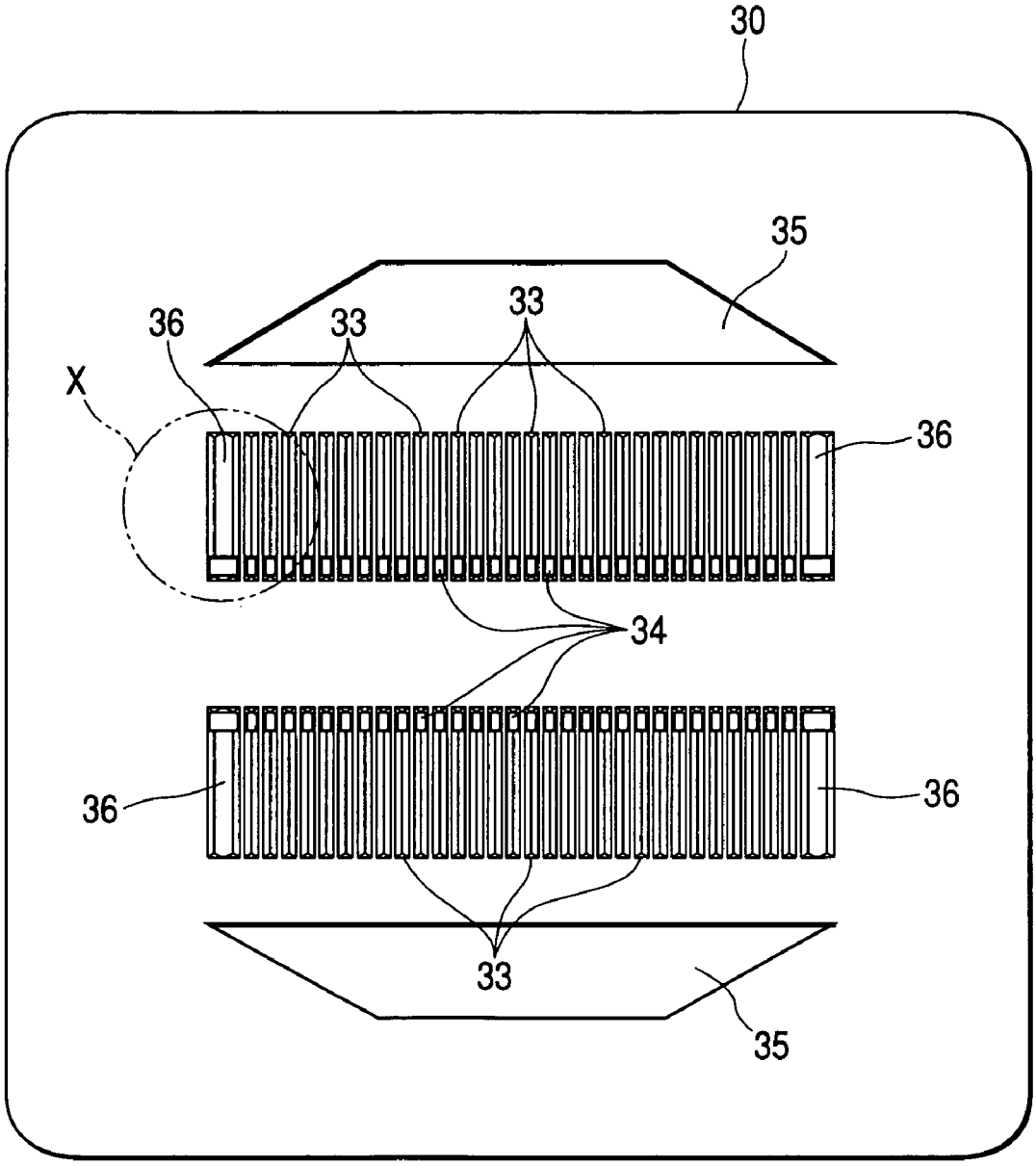
FIG. 4 a plan view of a pressure generating chamber forming plate.

As shown in FIG. 4, the pressure generating chamber forming plate 30 is a metal plate-like member in which grooves 33, communication ports 34, and clearance concave portions 35 are formed. In the present embodiment, the pressure generating chamber forming plate 30 is fabricated by working a nickel substrate that has a thickness of 0.35 mm.

Here, reasons why the nickel is selected as the substrate will be explained hereunder. A first reason is that a coefficient of linear expansion of the nickel is substantially equal to that of the metal (stainless in the present embodiment as described above) constituting major portions of the nozzle plate 31 and the sealing plate 32. More particularly, if the coefficients of linear expansion of the pressure generating chamber forming plate 30, the sealing plate 32, and the nozzle plate 31, which constitute the channel unit 4, are set uniformly, respective members are expanded uniformly when these members are heated/adhered. Therefore, the mechanical stress such as the camber, or the like due to difference in the coefficient of expansion is hard to occur. As a result, even when the adhesion temperature is set to a high temperature, respective members can be adhered mutually without hindrance. Also, if the piezoelectric vibrator 10 generates the heat in the operation of the recording head 1 and then the channel unit 4 is heated by this heat, respective members 30, 31, 32 constituting the channel unit 4 can be expanded uniformly. Hence, if the heating caused by the operation of the recording head 1 and the cooling caused by the operation stop are executed repeatedly, disadvantages such as peeling-off, etc. are difficult to occur in respective members 30, 31, 32 constituting the channel unit 4.

A second reason is that the nickel is excellent in the rust preventing characteristic. More particularly, since the aqueous ink is employed preferably in the recording head 1 of this type, it is important that deterioration such as rust, or the like should not be caused even though the moisture comes into contact with the substrate for a long term. In this respect, the nickel is excellent in the rust preventing characteristic to the same extent as the stainless, and thus the deterioration such as rust, or the like is hard to occur.

A third reason is that the nickel is rich in the malleability. More particularly, when the pressure generating chamber forming plate 30 is to be fabricated, such pressure generating chamber forming plate 30 is fabricated by the plastic working (e.g., the forging working) in the present embodiment, as described later. At this time, the grooves 33 and the communication ports 34 formed in the pressure generating chamber forming plate 30 have a very fine shape respectively, and thus a high dimensional precision is required. Then, if the nickel is employed as the substrate, the grooves 33 and the communication ports 34 can be formed with high dimensional precision even by the plastic working since the nickel is rich in the malleability.

In this case, if above respective requirements, i.e., the requirement of the coefficient of linear expansion, the requirement of the rust preventing characteristic, and requirement of the malleability about the pressure generating chamber forming plate 30 are satisfied, such pressure generating chamber forming plate 30 may be formed of the metal except the nickel.

Figure 5A:
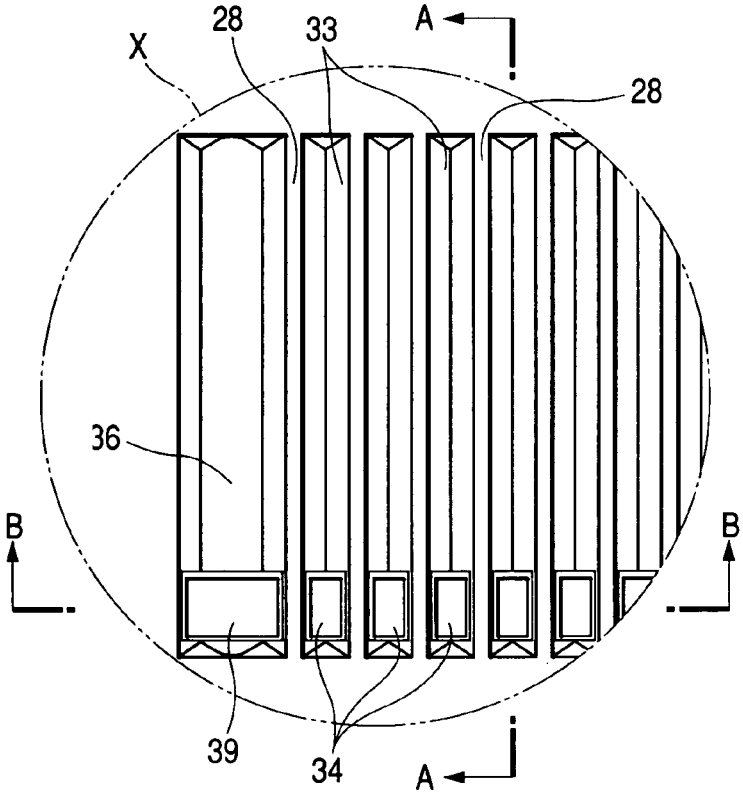
FIG. 5A is an enlarged view of an X portion in FIG. 4.
Figure 5B:
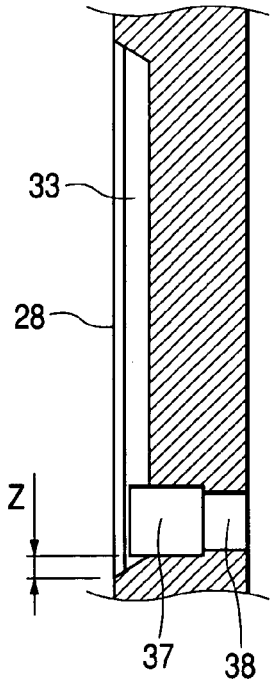
FIG. 5B is an A—A sectional view in FIG. 5A.
Figure 5C:
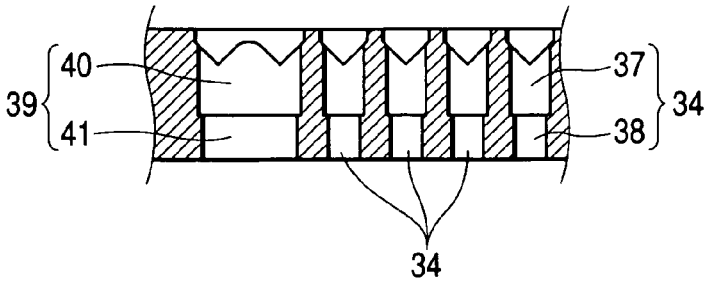
FIG. 5C is a B—B sectional view in FIG. 5A.

The grooves 33 act as pressure generating chambers 29, and an opening of the grooves 33 shaped into a rectangle, as shown in FIG. 5 in an enlarged fashion. The reason why the opening shape is formed as the rectangle is to facilitate the manufacture of the mate mold that is employed in the plastic working of the grooves 33. This respect will be explained later.

In the present embodiment, 180 grooves each of which has a width of about 0.1 mm, a length of about 1.5 mm, and a depth of about 0.1 mm are aligned in the groove width direction. A bottom face of the groove 33 is reduced toward the depth direction (i.e., inner side) to become hollow like a V-shape. The reason why the bottom face is formed to become hollow is to enhance a rigidity of a bulkhead portion 28 that partitions adjacent pressure generating chambers 29. In other words, a thickness of a root portion (portion on the bottom face side) of the bulkhead portion 28 is increased by forming the bottom face to become hollow like the V-shape, and thus the rigidity of the bulkhead portion 28 can be enhanced. Then, if the rigidity of the bulkhead portions 28 can be enhanced, the pressure generating chambers 29 are seldom influenced by the pressure variation from the adjacent pressure generating chambers 29. That is, variation in the ink pressure from the adjacent pressure generating chambers 29 is difficult to propagate to the pressure generating chambers 29. Also, the grooves 33 can be formed by the plastic working with good dimensional precision by forming the bottom face to become hollow like the V-shape (described later). Then, an angle of this V-shape is defined according to the working conditions and is set to almost 90 degree, for example.

In addition, a thickness of a top end portion of the bulkhead portion 28 is very thin, therefore a necessary volume can be assured even when the pressure generating chambers 29 are formed densely.

Also, in the present embodiment, both end portions of the groove 33 in the longitudinal direction are inclined downwardly toward the inner side. That is, both end portions of the groove 33 in the longitudinal direction are formed as a chamfered shape. In this structure, the groove 33 formed by the plastic working has a good dimensional precision.

In addition, dummy grooves 36 whose width is larger than the groove 33 are formed next to the grooves 33 located at both ends. This dummy groove 36 is a groove acting as a dummy pressure generating chamber that does not participate in ejection of the ink droplet (liquid droplet of the present invention). The dummy groove 36 of the present embodiment has a width of about 0.2 mm, a length of about 1.5 mm, and a depth of about 0.1 mm. Like the groove 33, the opening shape is shaped into the rectangle. Then, a bottom face of the dummy groove 36 is depressed like a W-shape. Also, this is provided to enhance the rigidity of the bulkhead portion 28 and to form the dummy groove 36 by the plastic working with good dimensional precision.

Then, the groove array is constructed by the grooves 33 and a pair of dummy grooves 36 arranged in line. In the present embodiment, two groove arrays are aligned laterally.

The communication ports 34 are formed in each groove array as through holes that pass through the plate thickness from one end portions (end portions on the ejection side) of the grooves 33. Then, 180 communication ports 34 are formed in one groove array. In the communication ports 34 in the present embodiment, the opening shapes are formed as the rectangle based on the same reason as the case of the grooves 33. The communication port 34 is pierced such that its one end (the lower side in FIG. 5B) is positioned on the inner side (in the opening of the grooves 33) than one end (the lower side in FIG. 5B similarly) of the groove 33 by less than 0.1 mm (a dimension Z in FIG. 5B).

Here, a plate thickness of the groove 33 at the bottom face is thin rather than a surrounding plate thickness. Hence, the load on the male mold (punch) employed in the plastic working at that time can be reduced and also buckling, etc. of the male mold can be prevented when the communication port 34 is formed in the opening of the groove 33, i.e., the overall communication port 34 is formed at the position that overlaps with one end portion of the groove 33. However, when a value of this dimension Z is larger than 0.15 mm, i.e., when a space from the end (end that is closer to the communication port 34) of the groove 33 to the communication port 34 is large, the bubble is ready to stagnate in this space. Then, if the bubbles are gathered and become large, there is caused such a problem that the bubbles absorb the pressure variation in the pressure generating chambers caused by the drive of the piezoelectric vibrator 10 and thus the ejection of the ink droplet is badly affected, etc. Therefore, it is preferable that the value of this dimension Z should be set to a value that is smaller than 0.15 mm (more preferably, less than 0.1 mm).

The communication port 34 of the present embodiment consists of a first communication port 37 formed in the pressure generating chamber forming plate 30 from the groove 33 side to the middle of the plate thickness direction, and a second communication port 38 formed from a face on the opposite side to the face having the groove 33 to the middle of the plate thickness direction.

Then, the first communication port 37 and the second communication port 38 have different sectional areas, and an inner dimension of the second communication port 38 is set slightly smaller than an inner dimension of the first communication port 37. This is due to the fact that the communication ports 34 are manufactured by the press working. In other words, since the pressure generating chamber forming plate 30 is fabricated by working the nickel plate having a thickness of 0.35 mm, a length of the communication port 34 is in excess of 0.25 mm after a depth of the groove 33 is subtracted. Then, since a width of the communication port 34 must be formed narrower than a recess width of the groove 33, the width is set to below 0.1 mm. For this reason, if it is tried to punch through the communication ports 34 by one working, the buckling of the male mold (punch), etc. are caused in connection with the aspect ratio.

Therefore, in the present embodiment, the working is separated into two steps. The first communication ports 37 are formed in the middle of the plate thickness direction in the first working step, and then the second communication ports 38 are formed in the second working step. In this case, procedures of working the communication ports 34 will be described later.

Also, a dummy communication port 39 is formed in the dummy groove 36. Like the above communication port 34, this dummy communication port 39 consists of a first dummy communication port 40 and a second dummy communication port 41, an opening shape of which is a rectangle. Also, an inner dimension of the second dummy communication port 41 is set slightly smaller than an inner dimension of the first dummy communication port 40.

In this case, in the present embodiment, those holes the opening shapes of which are constructed by rectangular through holes are exemplified as the communication ports 34 and the dummy communication ports 39, but they are not limited to those shapes. For example, those holes may be formed by the through holes that are opened as a circle.

The clearance concave portion 35 constitutes an operation space of the compliance portion in the common ink chamber 14. In the present embodiment, the clearance concave portion 35 is constructed by a trapezoidal concave portion that has the almost same shape as the concave portion 15 of the case 2 and has a depth equal to the groove 33. In the present embodiment, a depth of the clearance concave portion 35 is set to a midway of the plate thickness of the pressure generating chamber forming plate 30, but such clearance concave portion 35 may be formed as the through hole.

Next, the above sealing plate 32 will be explained hereunder. This sealing plate 32 is comprised of a composite material (one type of metal material of the present invention) having a double-layered structure that is obtained by laminating an elastic film 43 on a supporting plate 42, for example. In the present embodiment, a stainless plate is used as the supporting plate 42, and a PPS (polyphenylene sulfide) is used as the diaphragm portions 44.

Figure 6:
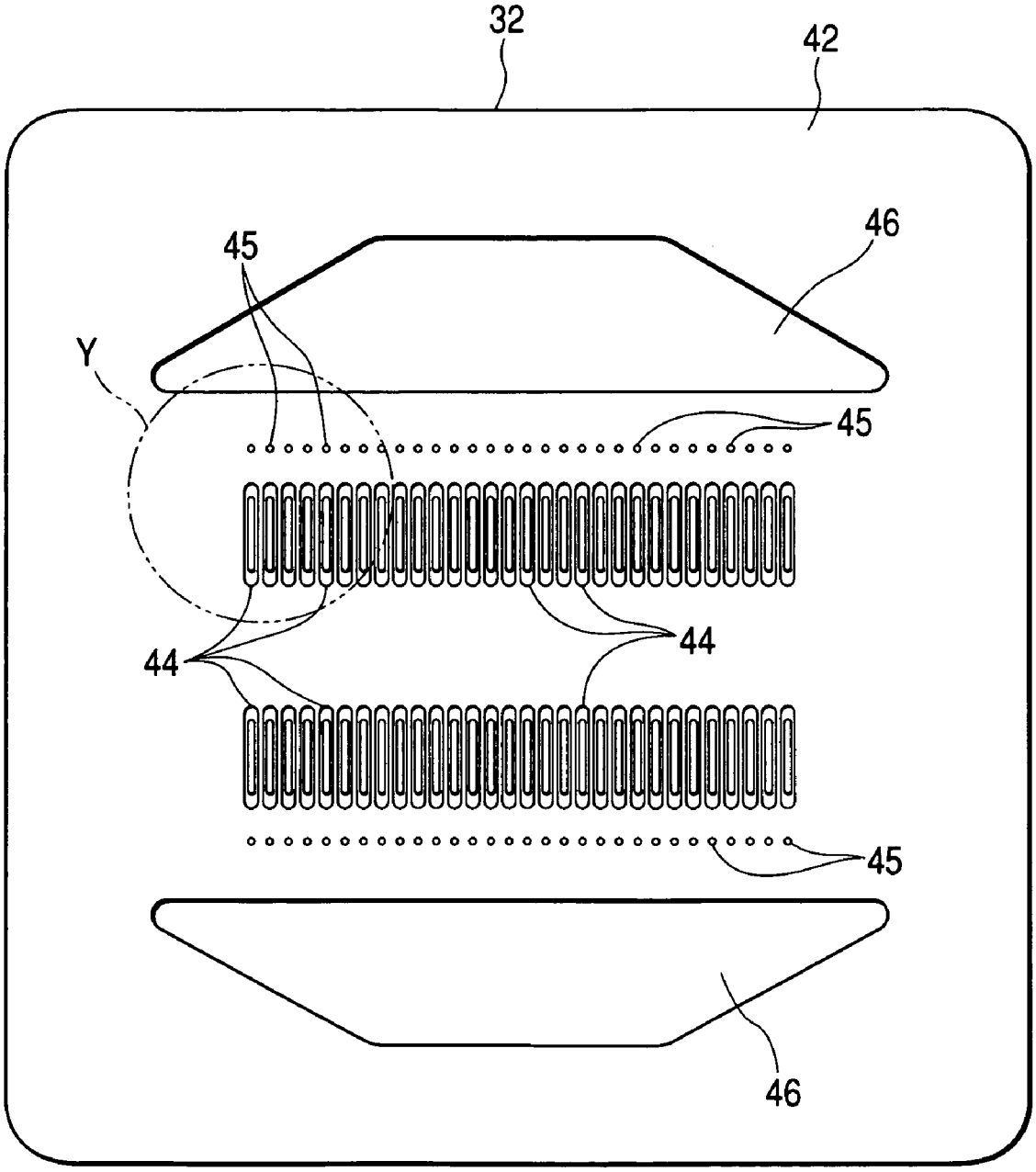
FIG. 6 show a plan view of an elastic plate.

As shown in FIG. 6, the sealing plate 32 includes diaphragm portions 44, ink supply ports (liquid supply ports in the present invention) 45, and compliance portions 46.

Figure 7A:
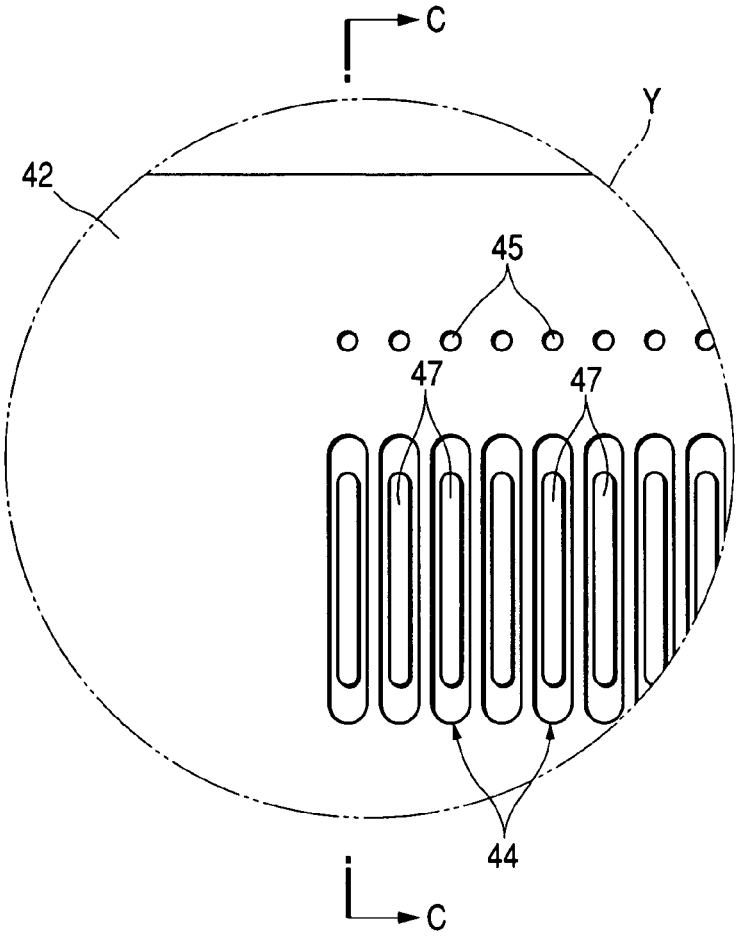
FIG. 7A is an enlarged view of a Y portion in FIG. 6.

The diaphragm portions 44 are portions that partition a part of the pressure generating chambers 29. That is, the diaphragm portions 44 seal opening faces of the grooves 33, and the diaphragm portions 44 together with the grooves 33 partition/form the pressure generating chambers 29. As shown in FIG. 7A, the diaphragm portion 44 has an elongated shape to correspond to the groove 33. The diaphragm portion 44 is formed in an sealing area, which seals the groove 33, and is corresponded to each groove 33. More particularly, a width of the diaphragm portion 44 is set substantially equal to the recess width of the groove 33, and a length of the diaphragm portion 44 is set slightly shorter than a length of the groove 33. In the present embodiment, the length of the diaphragm portion 44 is set to about ⅔ of the length of the groove 33. Then, as shown in FIG. 2, as for the forming position, one ends of the diaphragm portions 44 are arranged to coincide in level with one ends of the grooves 33 (the end portions of the communication ports 34 side).

Figure 7B:
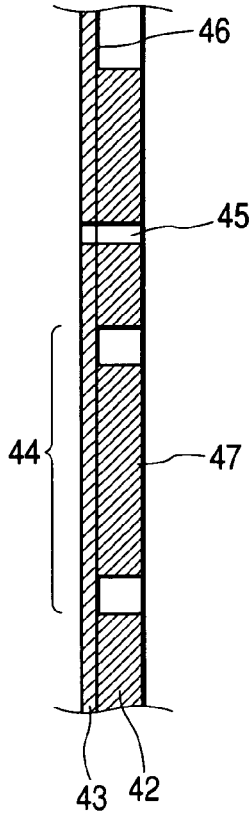
FIG. 7B is a C—C sectional view in FIG. 7A.

As shown in FIG. 7B, the diaphragm portion 44 is fabricated by removing the supporting plate 42 in the portion, which corresponds to the groove 33, like a ring by virtue of the etching, or the like to leave the diaphragm portions 44 only. An island portion 47 is formed within this ring. This island portion 47 is a portion to which the top face of the piezoelectric vibrator 10 is jointed.

The ink supply ports 45 are provided as holes that communicate the pressure generating chambers 29 with the common ink chamber 14 and penetrate the sealing plate 32 in the plate thickness direction. Like the diaphragm portions 44, the ink supply port 45 is also formed at the position, which corresponds to the groove 33, every groove 33. As shown in FIG. 2, this ink supply port 45 is pierced at the position that corresponds to the other end (end portion on the supply side) of the groove 33 on the opposite side to the communication port 34. Also, a diameter of this ink supply port 45 is set sufficiently smaller than the recess width of the groove 33. In the present embodiment, the ink supply port 45 is composed of a fine through hole of 23 micron.

The reason why the ink supply port 45 is formed as the fine through hole in this manner is to apply a channel resistance between the pressure generating chambers 29 and the common ink chamber 14. In other words, in this recording head 1, the ink droplet is ejected by utilizing the pressure applied to the ink in the pressure generating chambers 29. Hence, in order to eject the ink droplet effectively, it is important that an escape of an ink pressure from the pressure generating chambers 29 to the common ink chamber 14 side should be prevented as much as possible. In the present embodiment, the ink supply port 45 is formed by a fine through hole from this point of view.

Then, there is such an advantage that, if the ink supply port 45 is formed by the through hole like the present embodiment, the working is made easy and the high dimensional precision can be obtained. That is, since the ink supply port 45 is formed as the through hole, such port can be fabricated by the laser beam machining. Therefore, a fine diameter can be fabricated with high dimensional precision and the working can be facilitated.

A compliance portion 46 is a portion that partitions a part of the common ink chamber 14. That is, the common ink chamber 14 is formed by the compliance portion 46 and the concave portion 15. This compliance portion 46 has the almost same trapezoidal shape as the opening shape of the concave portion 15, and is fabricated by removing a portion of the supporting plate 42 by the etching, or the like to leave the elastic film 43 only.

In this case, the supporting plate 42 and the elastic film 43 constituting the sealing plate 32 are not restricted to this example. For example, polyimide may be employed as the elastic film 43. Also, this sealing plate 32 may be formed of a metal plate in which a thick thickness portion serving as the diaphragm portion 44 and a thin thickness portion provided around this thick thickness portion and a thin thickness portion serving as the compliance portion 46 are provided.

Next, the above nozzle plate 31 will be explained hereunder. The nozzle plate 31 is a metal plate member in which nozzle orifices 48 are aligned. In the present embodiment, a stainless plate is employed and a plurality of nozzle orifices 48 are opened at a pitch that corresponds to a dot forming density. A nozzle array is constructed by aligning 180 nozzle orifices 48 in total, and two nozzle arrays are formed.

Then, when this nozzle plate 31 is adhered to the other face of the pressure generating chamber forming plate 30, i.e., a face on the opposite side to the sealing plate 32, respective nozzle orifices 48 are positioned to face to the corresponding communication ports 34.

Then, when the above sealing plate 32 is jointed to one face of the pressure generating chamber forming plate 30, i.e., a face on which the grooves 33 are formed, the diaphragm portions 44 seal the opening faces of the grooves 33 and thus the pressure generating chambers 29 are formed. Similarly, the opening faces of the dummy grooves 36 are sealed and the dummy pressure generating chambers are formed. Also, when the above nozzle plate 31 is jointed to the other face of the pressure generating chamber forming plate 30, the nozzle orifices 48 are positioned to face to the corresponding communication ports 34. In this state, when the piezoelectric vibrator 10 jointed to the island portion 47 operates to expand and contract, the elastic film 43 around the island portion is deformed, whereby the island portion is pushed to the groove 33 side and is pulled to go away from the groove 33 side. The pressure generating chambers 29 are expanded and contracted according to such deformation of the elastic film 43, and thus the pressure variation is applied to the ink in the pressure generating chambers 29.

In addition, when the sealing plate 32 (i.e., the channel unit 4) is jointed to the case 2, the compliance portion 46 seals the top end concave portions 15. This compliance portion 46 absorbs the pressure variation of the ink stored in the common ink chamber 14. In other words, the elastic film 43 is deformed to expand and contract according to the pressure of the stored ink. Then, the above clearance concave portion 35 constitutes a space in which the elastic film 43 is to be expanded at the time of expansion of the elastic film 43.

The recording head 1 having the above structure has a common ink channel extended from the ink supply needle 19 to the common ink chamber 14 and individual ink channels extended from the common ink chamber 14 to respective nozzle orifices 48 via the pressure generating chambers 29. Then, the ink stored in the ink cartridge is introduced from the ink supply needle 19 and then is stored in the common ink chamber 14 via the common ink channel. The ink stored in the common ink chamber 14 is ejected from the nozzle orifices 48 via individual ink channels.

For example, when the piezoelectric vibrator 10 is contracted, the diaphragm portion 44 is pulled to the vibrator unit 3 side to expand the pressure generating chambers 29. Since a pressure in the inside of the pressure generating chambers 29 is reduced to a negative pressure according to this expansion, the ink in the common ink chamber 14 flows into respective pressure generating chambers 29 via the ink supply ports 45. Then, when the piezoelectric vibrator 10 is expanded, the diaphragm portion 44 is pushed toward the pressure generating chamber forming plate 30 side to contract the pressure generating chambers 29. The ink pressure in the pressure generating chambers 29 is increased according to this contraction, and thus the ink droplet is ejected from the correspond nozzle orifice 48.

Then, in this recording head 1, the bottom faces of the pressure generating chambers 29 (the grooves 33) are recessed like the V-shape. For this reason, a thickness of the root portion of the bulkhead portion 28, which partitions adjacent pressure generating chambers 29, is formed thicker than that of the top end portion. Accordingly, the rigidity of the bulkhead portion 28 can be enhanced rather than the related art. Therefore, even if pressure variation of the ink is caused in the pressure generating chambers 29 at the time of ejection of the droplet, such pressure variation is difficult to propagate to the adjacent pressure generating chambers 29. As a result, so-called adjacent crosstalk can be prevented and thus the ejection of the ink droplet can be stabilized.

Also, in the present embodiment, since the ink supply ports 45 for communicating the common ink chamber 14 and the pressure generating chambers 29 are composed of the fine holes that pass through the sealing plate 32 in the plate thickness direction, the high dimensional precision can be implemented easily by the press working, the laser beam machining, or the like. Hence, the flow-in characteristics (inlet velocity, inlet amount, etc.) of the ink into respective pressure generating chambers 29 can be set uniformly at a high level. In addition, if the press or the laser beam is employed to work, the working can be facilitated.

Also, in the present embodiment, the dummy pressure generating chambers (i.e., the space portions that are partitioned by the dummy groove 36 and the sealing plate 32), which have no connection with the ejection of the ink droplet, are provided next to the pressure generating chambers 29 located in end portions of the alignment. Thus, the pressure generating chamber 29 is formed on one side of the pressure generating chamber 29 located on the side of the alignment, and the dummy pressure generating chamber is formed on the other side thereof. Therefore, the rigidity of the bulkhead portions that partition the pressure generating chambers 29 located on both end portions of the alignment can be set equal to the rigidity of the bulkhead portions assigned to remaining pressure generating chambers 29 located in the middle of the alignment. As a result, the ink droplet ejecting characteristics of all the pressure generating chambers 29 on the alignment can be set uniformly.

In addition, a width of the dummy pressure generating chambers in the alignment direction is formed wider than a width of the pressure generating chambers 29. In other words, a width of the dummy groove 36 is set wider than a width of the groove 33. Therefore, the ejection characteristics of the pressure generating chambers 29 located on both end portions of the alignment and the pressure generating chambers 29 located in the middle of the alignment can be made equal with higher precision.

Further, in the present embodiment, the concave portion 15 is formed by recessing partially the top face of the case 2, and the common ink chamber 14 is formed by the concave portion 15 and the sealing plate 32. Therefore, the dedicated member used to form the common ink chamber 14 is not required and thus simplification of the structure can be achieved. Also, since the case is fabricated by the resin molding, fabrication of the concave portion 15 can be made relatively easy.

Next, a method of manufacturing the above recording head 1 will be explained hereunder. In this case, since a feature of this manufacturing method resides in the manufacturing steps of the above pressure generating chamber forming plate 30, such manufacturing steps of the pressure generating chamber forming plate 30 will be explained mainly.

In this case, the pressure generating chamber forming plate 30 is fabricated by the forging processing using the sequential feeding mold. Also, the band plate used as the material of the pressure generating chamber forming plate 30 is formed of nickel, as described above.

The manufacturing steps of the pressure generating chamber forming plate 30 comprises groove forming steps of forming the grooves 33 and communication port forming steps of forming the communication ports 34, and are carried out by the sequential feeding mold.

Figure 8A:
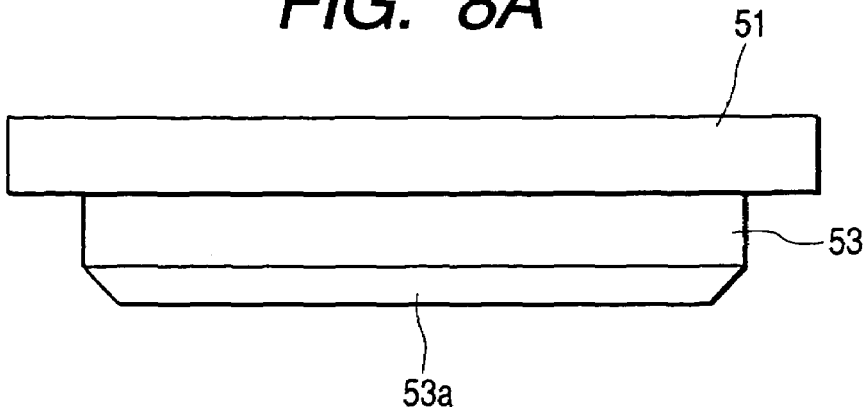
FIGS. 8A and 8B and B show views explaining a first male mold employed to form grooves.
Figure 8B:
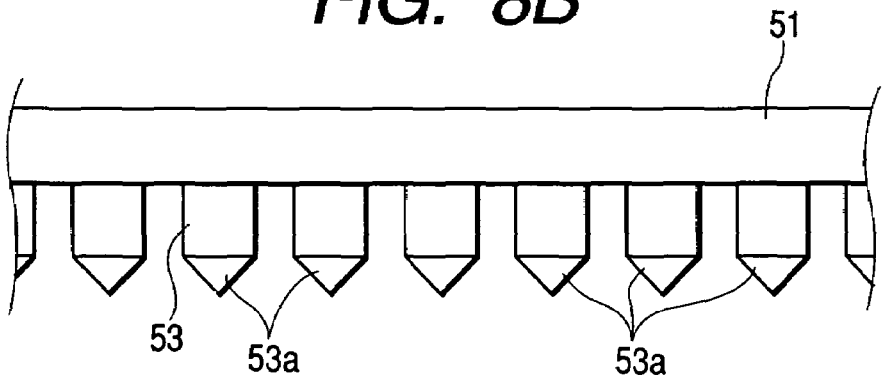
Figure 9A:
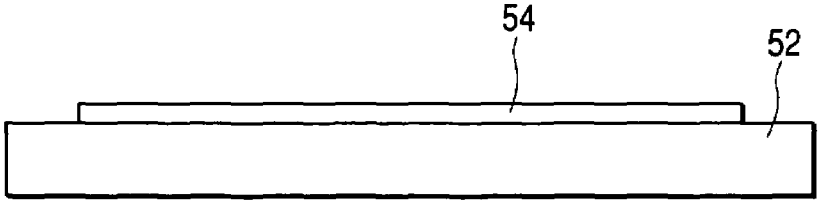
FIGS. 9A and 9B show views explaining a female mold employed to form grooves.

In the groove forming steps, a first male mold 51 shown in FIG. 8 and a female mold 52 shown in FIG. 9 are employed. The first male mold 51 is a groove forming male mold in the present invention. In this male mold, ridge portions 53 used to form the grooves 33 are aligned as many as the grooves 33. Also, dummy ridge portions (not shown) used to form the dummy grooves 36 are provided adjacent to the ridge portions 53 located on both end portions of the alignment. Top end portions 53*a* of the ridge portions 53 are tapered away and are chamfered from the center in the width direction at an angle of about 45 degree, for example, as shown in FIG. 8B. Thus, such top end portions 53*a* are sharpened into the V-shape when viewed from the longitudinal direction. Also, both ends of the top end portions 53*a* in the longitudinal direction are shapes chamfered at an angle of about 45 degree, as shown in FIG. 8A.

Here, a method of fabricating the first male mold 51 will be explained with reference to FIG. 10.

Figure 10A:
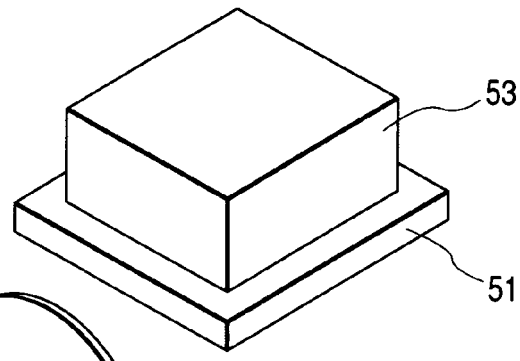
FIGS. 10A to 10D show views explaining a method of forming the first male mold.
Figure 10B:
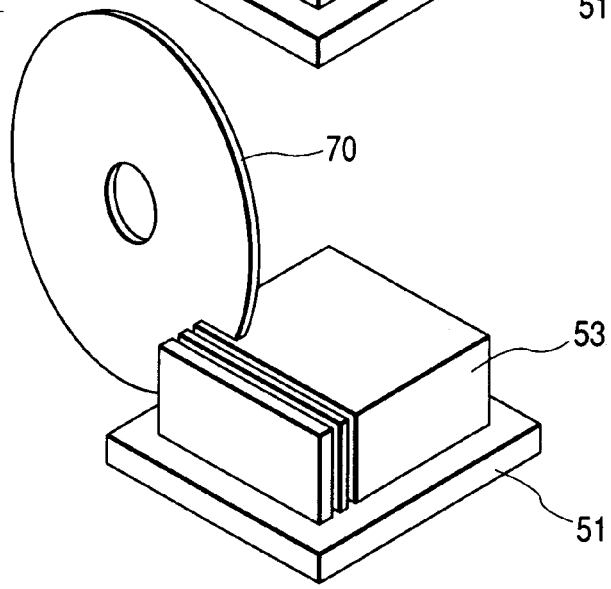
Figure 10C:
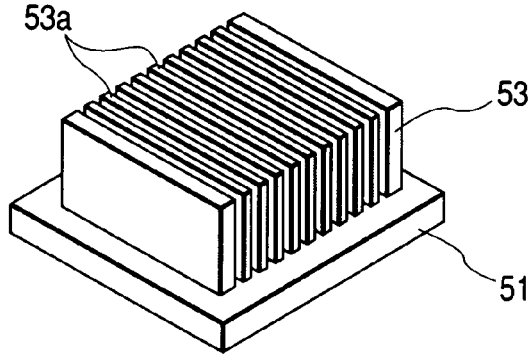
Figure 10D:
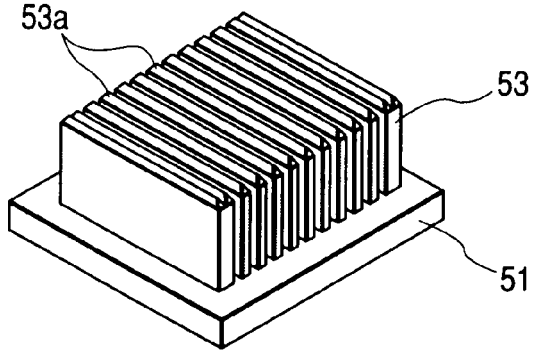

First, the grooving is applied sequentially to portions, which act as the recesses between the ridge portions 53, of a metal block material constituting the ridge portions 53 of the first male mold 51, as shown in FIG. 10A, by using the dicing saw, or the like shown in FIG. 10B. At this time, a depth of the recess is set to a depth that is required for the grooves 33. In FIG. 10, the recesses reach the roots of the ridge portions 53, but such recesses may be formed up to the middle of the thickness direction to enhance the strength of the mold. Then, as shown in FIG. 10C, the ridge portions 53 that are aligned to correspond to respective grooves 33 are formed. Then, as shown in FIG. 10D, the top end portions 53*a* are formed by polishing the top ends of the ridge portions 53 to sharpen like the V-shape and then chamfering both ends of the ridge portions 53 in the longitudinal direction.

Meanwhile, one reason why the ridge portions 53 are aligned as many as the grooves 33 by applying the grooving is given as follows. That is, according to the method of press-working sequentially the grooves 33 one by one by using one ridge portion 53, not only a working time is needed correspondingly but also the subsequent working interferes with the groove 33 formed by the preceding processing to cause the deformation and thus the grooves 33 cannot be shaped into the uniform shape. Therefore, in order to prevent the above disadvantage, respective grooves 33 must be formed at a time by one press working. Also, another reason is given as follows. That is, the fabricating operation can be facilitated in contrast to the case where the mold is fabricated by forming the top end portions 53*a* in the same number as the grooves 33 one by one and then burying the formed top end portions 53*a* in the base, and also such fabricating operation is excellent in cost and precision.

In the above, a method of fabricating the first male mold 51 (the ridge portions 53, the top end portions 53*a*) is explained. In this case, since first communication port forming portions 56 and second communication port forming portions 58 are formed as the rectangle in a method of fabricating a second male mold 57 and a third male mold 59 to be described later, the grooving and the polishing can be applied similarly to the block member. Thus, their explanation will be omitted herein.

Here, the opening shapes of the grooves 33 and the communication ports 34 may be shaped into a shape except the rectangle (e.g., the opening shapes of the grooves 33 may be shaped into an ellipse and the opening shapes of the communication ports 34 may be shaped into a circle). Since the male mold must be worked to meet to such shapes, an amount of operation is not a little increased in contrast to the case where the opening shapes are shaped into the rectangle. Like the present embodiment, if the opening shapes are set to the rectangle, the male mold can be fabricated by a relatively small amount of operation such as two steps of the grooving and the polishing.

Figure 9B:
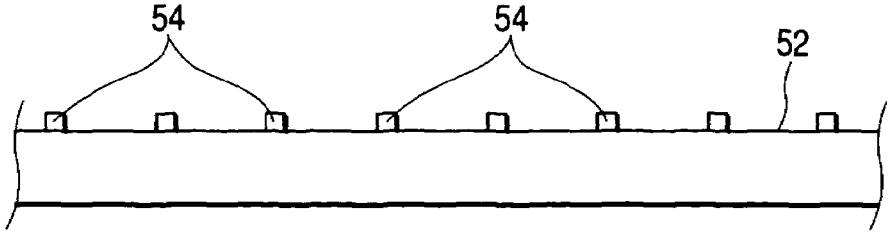

Next, the female mold 52 will be explained as directed below. As shown in FIG. 9B, a plurality of stripe shaped projections 54 are formed on an upper face of the female mold 52. The stripe shaped projections 54 assist to the formation of the bulkhead portions that partition adjacent pressure generating chambers 29, and are positioned between the grooves 33. The stripe shaped projections 54 are formed like a square pole. A width of the stripe shaped projection 54 is set slightly narrower than an interval (thickness of the bulkhead) between adjacent pressure generating chambers 29, and a height thereof is set to the same extent as the width. Also, a length of the stripe shaped projection 54 is set to the same extent as a length of the groove 33 (the ridge portion 53).

Figure 11A:
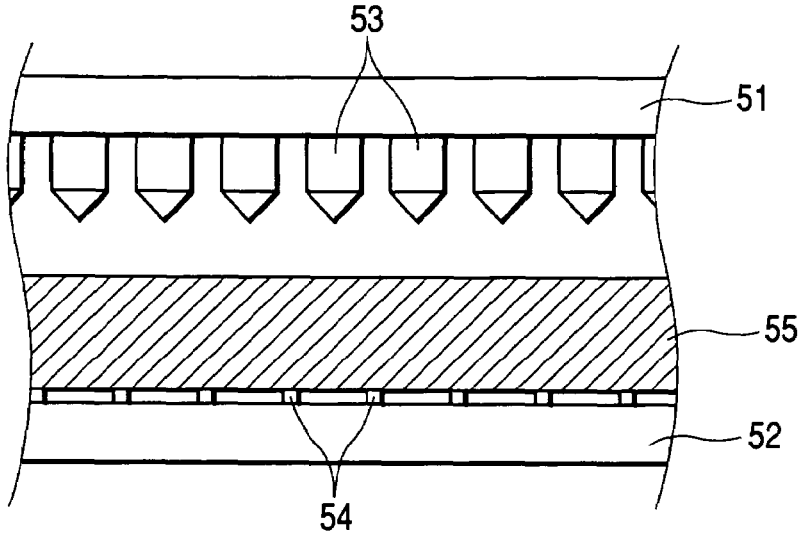
FIGS. 11A to 11C show schematic views explaining formation of the grooves.
Figure 11B:
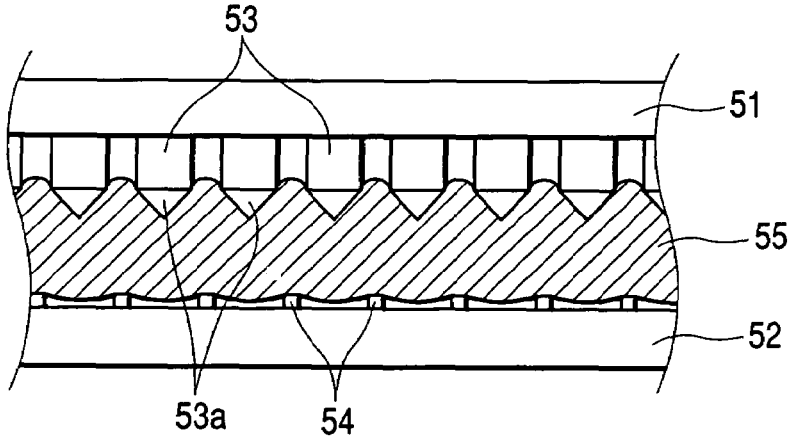
Figure 11C:
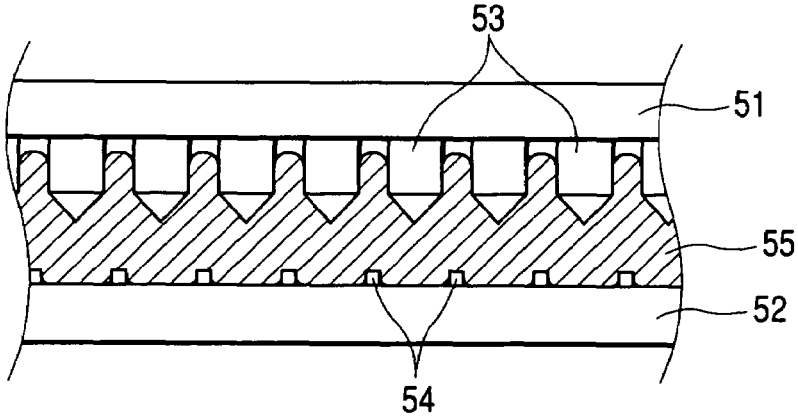

Then, in the groove forming steps, as shown in FIG. 11A, a band plate 55 is put on an upper face of the female mold 52, and then the first male mold 51 is arranged over the band plate 55. Then, as shown in FIG. 11B, the top end portions of the ridge portion 53 are pushed into the band plate 55 by bringing the first male mold 51 downward. At this time, since the top end portions 53*a* of the ridge portion 53 are sharpened like the V-shape, such top end portions 53*a* can be pushed into the ridge portion 53 without fail not to cause the buckling of the ridge portion 53. As shown in FIG. 11C, such pushing of the ridge portions 53 is executed up to the half way of the band plate 55 in the plate thickness direction.

A part of the band plate 55 is moved by the pushing of the ridge portions 53, and thus the grooves 33 are formed. Here, since the top end portions 53*a* of the ridge portion 53 are sharpened like the V-shape, even the fine-shaped grooves 33 can be fabricated with high dimensional precision. In other words, since the portions that are pushed by the top end portions 53*a* are moved smoothly, the grooves 33 to be formed can be formed along the shapes of the ridge portions 53. In addition, since both ends of the top end portions 53*a* in the longitudinal direction are chamfered, the band plate 55 that is pushed by the concerned portions can also be moved smoothly. Therefore, both end portions of the grooves 33 in the longitudinal direction can be fabricated with high dimensional precision.

Also, since the pushing of the ridge portions 53 is stopped in the half way of the plate thickness direction, the thick band plate 55 can be employed rather than the case where the grooves 33 are formed as the through holes. Therefore, the rigidity of the pressure generating chamber forming plate 30 can be enhanced and thus the improvement in the ejection characteristic of the ink droplet can be achieved. Also, the handling of the pressure generating chamber forming plate 30 can be facilitated.

Also, a part of the band plate 55 is raised in spaces between adjacent ridge portions 53 because the band plate 55 is pushed by the ridge portions 53. Here, since the stripe shaped projection 54 provided to the female mold 52 are arranged at positions that correspond to the space between the ridge portions 53, they can assist the flow of the band plate 55 into the spaces. Accordingly, the band plate 55 can be introduced effectively into the spaces between the ridge portions 53, and raised portions can be formed highly.

After the grooves 33 are formed in this manner, the process goes to the communication port forming steps to form the communication ports 34. In the communication port forming steps, as shown in FIG. 12, the second male mold 57 and the third male mold 59 are employed. The second male mold 57 and the third male mold 59 function as a communication port forming male mold of the present invention.

Here, the second male mold 57 is such a mold that a plurality of first communication port forming portions 56 formed like square poles that correspond to the shapes of the first communication ports 37 are provided like the teeth of a comb, i.e., a plurality of first communication port forming portions 56 are provided to stand upright from the base. Also, the third male mold 59 is such a mold that a plurality of second communication port forming portions 58 formed like square poles that correspond to the shapes of the second communication ports 38 are provided like the teeth of a comb. In this case, the second communication port forming portions 58 are fabricated to have the shapes that are thinner than the first communication port forming portions 56.

Figure 12A:
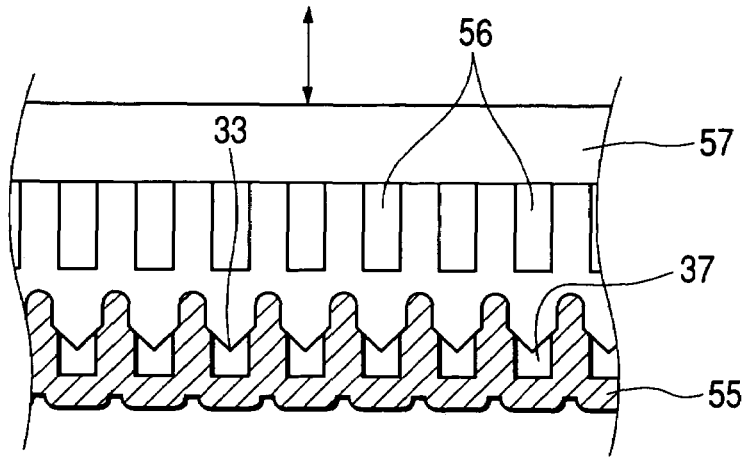
FIGS. 12A to 12C show schematic views explaining formation of communication ports.
Figure 12B:
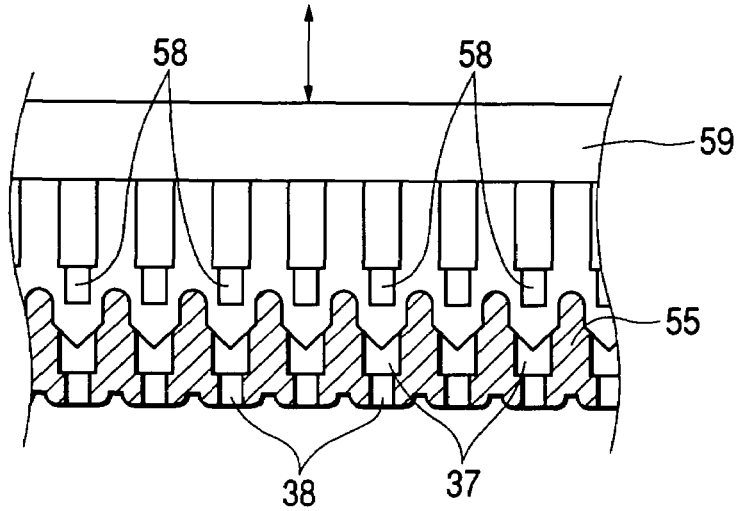
Figure 12C:
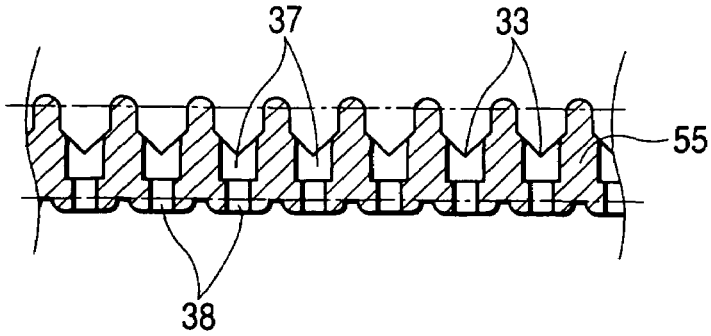

In the communication port forming steps, as shown in FIG. 12A, first recess portions as the first communication ports 37 are formed by pushing the first communication port forming portions 56 of the second male mold 57 up to the half way of the plate thickness direction from a face of the band plate 55 on the grooves 33 side (first communication port forming step). After the recess portions as the first communication ports 37 are formed, the second communication ports 38 are formed by pushing the second communication port forming portions 58 of the third male mold 59 from the groove 33 side to punch through bottom portions of the first communication ports 37, as shown in FIG. 12B (second communication port forming step).

In this manner, in the present embodiment, since the communication ports 34 are fabricated by plural working steps using the communication port forming portions 56, 58 having different thicknesses, even the very fine communication ports 34 can be fabricated with good dimensional precision.

In addition, since the first communication ports 37 formed from the groove 33 side are fabricated merely up to the half way of the plate thickness direction, such a disadvantage can be prevented that the bulkhead portions 28 of the pressure generating chambers 29 are pulled excessively during the fabrication of the first communication ports 37. Therefore, the first communication ports 37 can be fabricated with good dimensional precision without the damage of the shapes of the bulkhead portions 28.

In this case, in the present embodiment, steps of fabricating the communication ports 34 by two workings are exemplified. But the communication ports 34 may be fabricated by three working steps or more. Also, unless the above disadvantage is caused, the communication ports 34 may be fabricated by one working After the communication ports 34 are fabricated, a face of the band plate 55 on the groove 33 side and a face thereof on the opposite side are polished to planarize (polishing step). In other words, as indicated by a dot-dash line of FIG. 12C, the face on the groove 33 side and the face on the opposite side are polished to planarize these faces and to adjust the plate thickness into a predetermined thickness (0.3 mm in the present embodiment).

In this case, the forming step forming step and the communication port forming step may be executed at separate stages or at the same stage. Then, since the band plate 55 is not moved in both steps when these steps are executed at the same stage, the communication ports 34 can be fabricated in the grooves 33 with good positional precision.

After the pressure generating chamber forming plate 30 is fabricated according to the above steps, the channel unit 4 is fabricated by jointing the sealing plate 32 and the nozzle plate 31, which have been prepared separately, to the pressure generating chamber forming plate 30. In the present embodiment, such jointing of these members is implemented by the adhesion. At the time of this adhesion, the sealing plate 32 and the nozzle plate 31 can be adhered without fail since the face of the pressure generating chamber forming plate 30 is planarized by the above polishing step.

Also, since the sealing plate 32 is formed of the composite material using a stainless plate as the supporting plate 42, its coefficient of linear expansion is defined by the stainless as the supporting plate 42. Then, the nozzle plate 31 is also formed of the stainless plate. In addition, a coefficient of linear expansion of the nickel constituting the pressure generating chamber forming plate 30 is almost equal to the stainless, as described above. Therefore, the camber due to difference in the coefficient of linear expansion is not generated even when the adhesive temperature is increased. As a result, the adhesive temperature can be increased higher than the case where the silicon substrate is employed, and thus an adhesive time can be shortened and also the manufacturing efficiency can be improved.

After the channel unit 4 is fabricated, the vibrator unit 3 and the channel unit 4 are jointed to the case 2 that is manufactured separately. In this case, the jointing of these members is implemented by the adhesion. Therefore, no camber is generated in the channel unit 4 even when adhesive temperature is increased, and thus the adhesive time can be shortened.

After the vibrator unit 3 and the channel unit 4 are jointed to the case 2, the flexible cable 9 of the vibrator unit 3 and the connection substrate 5 are connected by the soldering, and then the supply needle unit 6 is fitted.

By the way, the present invention is not limited to the above embodiments and various variations may be applied based on the recitation set forth in claims.

First, when the thickness of the root portion of the bulkhead portion 28 is set thicker than the top end portion, the rigidity of the bulkhead portion 28 can be increased rather than the related art and thus a volume necessary for the pressure generating chambers 29 can be assured. According to this viewpoint, the recess shape on the bottom faces of the grooves is not limited to the V-shape. For example, the bottom faces of the grooves 33 may be depressed like a circular arc. Then, in order to fabricate the grooves 33 having such bottom shape, the first male mold 51 having the ridge portions 53 whose top end portion is tapered away like the circular arc may be employed.

Also, an element except the piezoelectric vibrator 10 may be employed as the pressure generating element. For example, the electro-mechanical transducer element such as the electrostatic actuator, the magnetostrictic element, or the like may be employed. In addition, the heat generating element may be employed as the pressure generating element.

Figure 13:
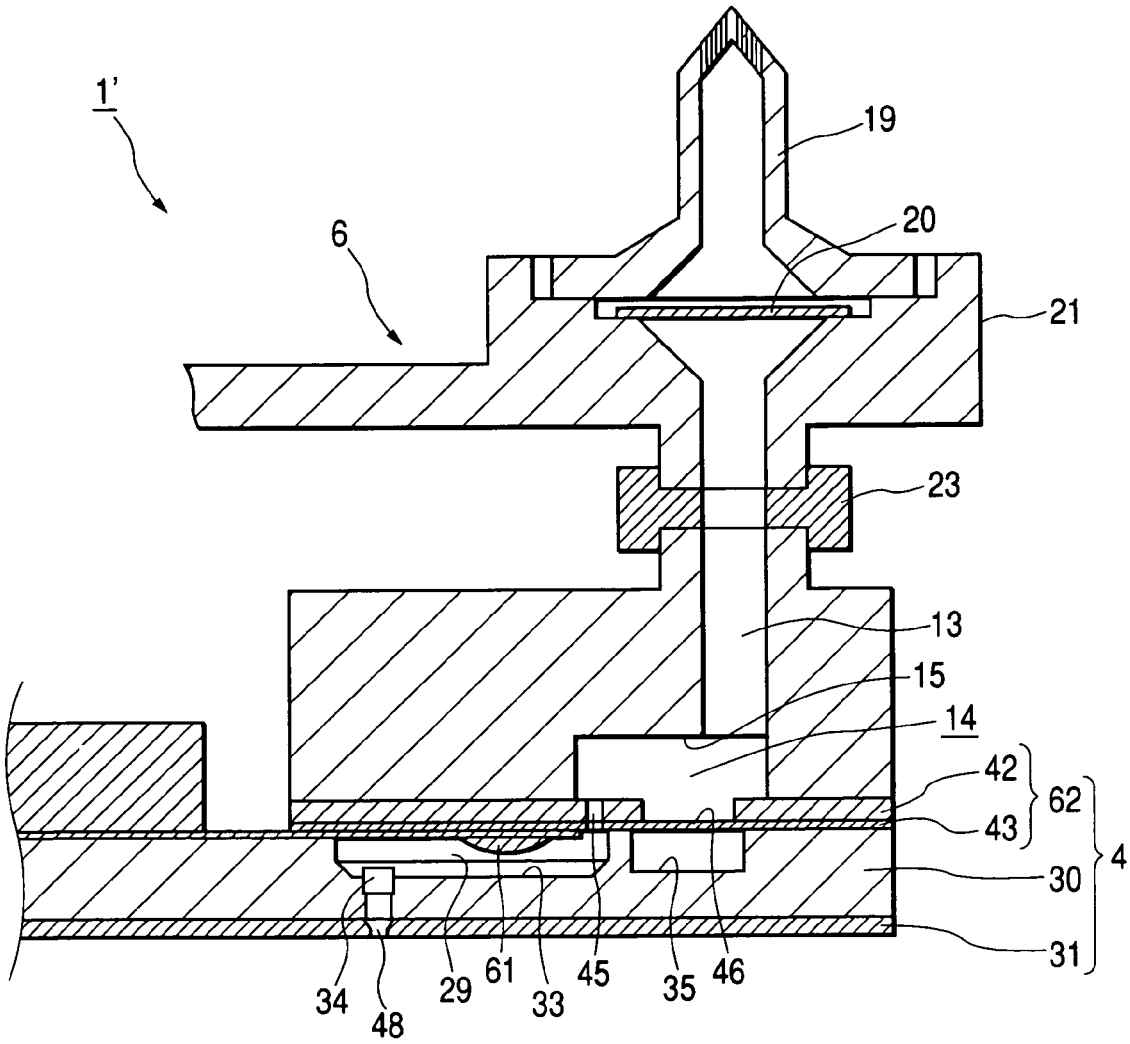
FIG. 13 shows a sectional view explaining a recording head in a variation.

A recording head 1' shown in FIG. 13 employs a heat generating element 61 as the pressure generating element. In this example, a sealing substrate 62 on which the compliance portions 46 and the ink supply ports 45 are provided (one type of the sealing plate in the present invention) is employed in place of the above sealing plate 32, and the groove 33 side of the pressure generating chamber forming plate 30 is sealed by this sealing substrate 62. Also, in this example, the heat generating element 61 is fitted to a face of the sealing substrate 62 in the pressure generating chambers 29. This heat generating element 61 generates the heat when the electric power is fed via the electrical wirings.

In this case, since the structures of the pressure generating chamber forming plate 30, the nozzle plate 31, and others are similar to those in the above embodiments, their explanation will be omitted herein.

In this recording head 1', the bumping of the ink in the pressure generating chambers 29 is caused by feeding the electric power to the heat generating element 61, and then the bubble that is generated by this bumping applies the pressure to the ink in the pressure generating chambers 29. According to this pressurization, the ink droplet is ejected from the nozzle orifice 48.

Then, in this recording head 1', since the pressure generating chamber forming plate 30 is fabricated by the plastic working of the metal, the same advantages as those in the above embodiments can be achieved.

Also, in the above embodiments, the example in which the pressure generating chamber forming plate 30 is fabricated by the forging working as one type of the plastic working is explained as the working of the pressure generating chamber forming plate 30, but such working is not limited to this. In addition, the material used to fabricate the pressure generating chamber forming plate 30 is not limited to a single metal plate from such a viewpoint that the root portion of the bulkhead portion 28 should be formed thicker than the top end portion. For example, a laminated plate member constructed by laminating a plurality of plate members may be employed, and a coating plate material constructed by coating a resin on a face of the metal plate may be employed.

In addition, in the above embodiments, the example in which the communication ports 34 are provided to one end portions (one end side) of the grooves 33 and in the openings of the grooves 33 is explained as the communication ports 34, but such grooves 33 are not limited to this. The communication ports 34 may be provided at any positions if at least a part of the communication ports 34 overlaps with a part of the grooves 33 and the overall communication ports 34 enter into the range of the width of the grooves. For example, the communication ports 34 may be formed in the almost middle of the grooves 33 in the longitudinal direction. In this case, as described above, it is preferable that, in order to avoid the stagnation of the bubble in the pressure generating chambers 29, the communication ports 34 should be formed at the position at which the dimension Z in FIG. 5 is less than 0.15 mm.

Figure 14A:
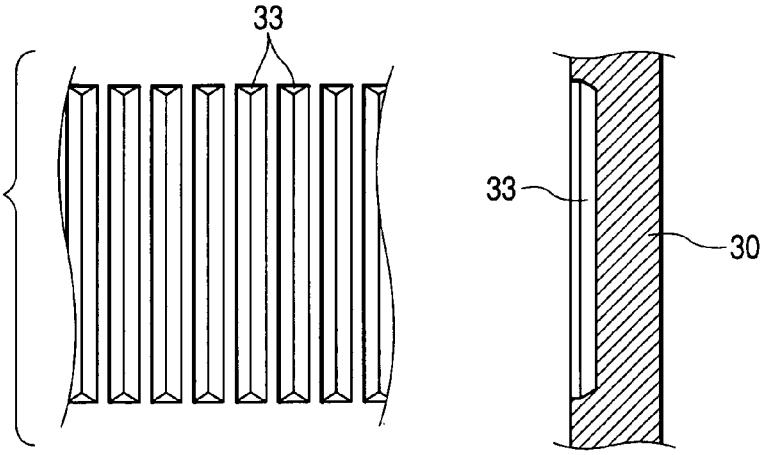
FIGS. 14A to 14C show views explaining another embodiment of the formation of the communication ports.
Figure 14B:
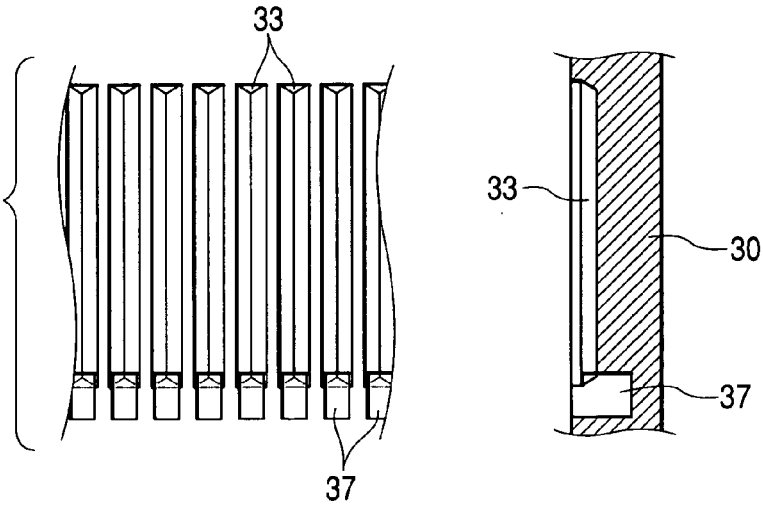
Figure 14C:
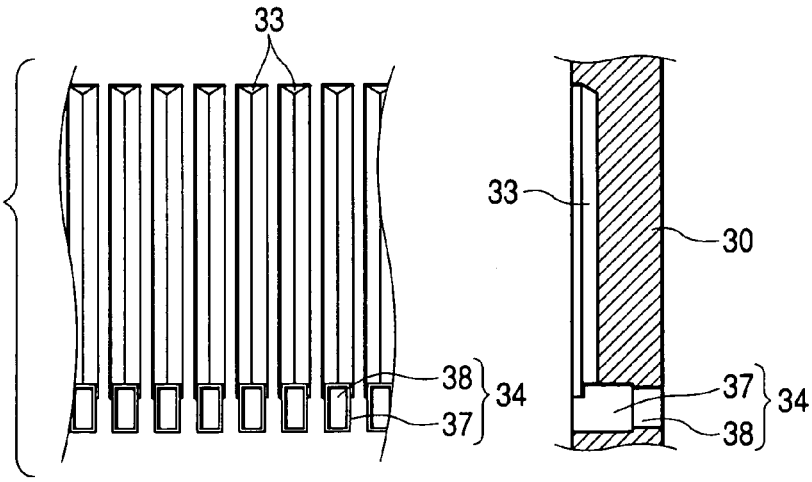

Also, unless the problem of the burden on the male mold in the press working is not caused, the communication ports 34 can be formed such that a part of such communication ports 34 overlaps with the grooves 33 and other portions (remaining portion) are positioned on the outside of the grooves 33 (on the outside of the openings of the grooves 33), as shown in FIG. 14. In this example, the first communication ports 37 are formed up to the half way of the pressure generating chamber forming plate 30 in the plate thickness direction such that, as shown in FIG. 14B, a part (upper side in FIG. 14) of the first communication ports 37 overlaps with one end portions of the grooves 33 that are subjected previously to the press working, as shown in FIG. 14A, and also remaining portion (lower side in FIG. 14) is positioned on the outside of the grooves 33. Then, as shown in FIG. 14C, the second communication ports 38 are formed by punching through the pressure generating chamber forming plate 30. In this embodiment, since a value of the Z dimension shown in FIG. 5 is set to zero (strictly speaking, a negative value since other ends of the communication ports 37, 38 are formed on the outside of the grooves 33). That is, the area in which the bubble is ready to stagnate can be eliminated, and therefore the ejection of the ink droplet can be stabilized and the reliability can be improved.

In the above, the example in which the present invention is applied to the ink jet recording head is explained, but the present invention is not limited to this. For example, the present invention can be applied to other liquid jetting heads such as a coloring material jetting head employed to manufacture a color filter such as a liquid crystal display, etc., an organic EL display, an electrode material jetting head employed to form electrodes of FED, etc., a bioorganic substance jetting head employed to manufacture a biochip, or the like. Then, instead of the above ink, the liquid in which coloring material of RGB (Red, Green, Blue) are dissolved is employed in the coloring material jetting head, the liquid in which the electrode material is dissolved is employed in the electrode material jetting head, and the liquid in which the organic substance is dissolved is employed in the bioorganic substance jetting head.

What is claimed is:

1. A liquid jetting head comprising:

a nozzle plate, provided with a plurality of nozzle orifices;

a liquid passage plate, having a first face and a second face which are opposite to each other, and provided with a plurality of grooves which are arranged in a first direction perpendicular to a longitudinal direction of the groove on the first face, each groove having a communication port which passes through from the first face to the second face; and a sealing plate for sealing opening faces of the grooves, wherein the sealing plate is jointed to the first face so that a plurality of pressure generating chambers are formed;

wherein the nozzle plate is jointed to the second face such that the communication holes are communicated with the nozzle orifices respectively;

wherein a thickness of root portions of bulkhead portions, which partition adjacent pressure generating chambers, is formed thicker than a thickness of top end portions thereof.

2. The liquid jetting head as set forth in claim 1, wherein bottom faces of the grooves are recessed in a V-shape.

3. The liquid jetting head as set forth in claim 1, wherein bottom faces of the grooves are recessed in a circular arc.

4. A liquid jetting head comprising:

a nozzle plate, provided with a plurality of nozzle orifices;

a liquid passage plate, having a first face and a second face which are opposite to each other, and provided with a plurality of grooves which are arranged in a first direction perpendicular to a longitudinal direction of the groove on the first face, each groove having a communication port which passes through from the first face to the second face; and a sealing plate for sealing opening faces of the grooves, wherein the sealing plate is jointed to the first face so that a plurality of pressure generating chambers are formed;

wherein the nozzle plate is jointed to the second face such that the communication holes are communicated with the nozzle orifices respectively;

wherein each communication port includes a first communication port formed to the middle of the liquid passage plate in a plate thickness direction from the first face, and a second communication port formed from a bottom face of the first communication port to the second face; and wherein an inner dimension of the second communication port is smaller than that of the first communication port.

5. A liquid jetting head comprising:

a nozzle plate, provided with a plurality of nozzle orifices;

a liquid passage plate, having a first face and a second face which are opposite to each other, and provided with a plurality of grooves which are arranged in a first direction perpendicular to a longitudinal direction of the groove on the first face, each groove having a communication port which passes through from the first face to the second face; and a sealing plate for sealing opening faces of the grooves, wherein the sealing plate is jointed to the first face so that a plurality of pressure generating chambers are formed;

wherein the nozzle plate is jointed to the second face such that the communication holes are communicated with the nozzle orifices respectively;

wherein the sealing plate has liquid supply ports communicated with the pressure generating chambers respectively such that liquid flows from a common liquid chamber to the pressure generating chambers via the liquid supply ports.

6. A liquid jetting head comprising:

a nozzle plate, provided with a plurality of nozzle orifices;

a liquid passage plate, having a first face and a second face which are opposite to each other, and provided with a plurality of grooves which are arranged in a first direction perpendicular to a longitudinal direction of the groove on the first face, each groove having a communication port which passes through from the first face to the second face; and a sealing plate for sealing opening faces of the grooves, wherein the sealing plate is jointed to the first face so that a plurality of pressure generating chambers are formed;

wherein the nozzle plate is jointed to the second face such that the communication holes are communicated with the nozzle orifices respectively;

wherein at least a part of each communication port is overlapped with one end portion of each groove; and wherein each communication port is positioned into a range of a width of each groove.

7. The liquid jetting head as set forth in claim 6, wherein each communication port is wholly included in each groove.

8. The liquid jetting head as set forth in claim 6, wherein at least a part of each communication port is overlapped with each groove; and wherein other portion thereof is positioned on an outside of each groove.

9. A liquid jetting head comprising:

a nozzle plate, provided with a plurality of nozzle orifices;

a liquid passage plate, having a first face and a second face which are opposite to each other, and provided with a plurality of grooves which are arranged in a first direction perpendicular to a longitudinal direction of the groove on the first face, each groove having a communication port which passes through from the first face to the second face; and a sealing plate for sealing opening faces of the grooves, wherein the sealing plate is jointed to the first face so that a plurality of pressure generating chambers are formed;

wherein the nozzle plate is jointed to the second face such that the communication holes are communicated with the nozzle orifices respectively;

wherein the liquid passage plate is comprised of laminated material formed by superposing a plurality of plate materials.

10. A liquid jetting head comprising:

a nozzle plate, provided with a plurality of nozzle orifices;

a liquid passage plate, having a first face and a second face which are opposite to each other, and provided with a plurality of grooves which are arranged in a first direction perpendicular to a longitudinal direction of the groove on the first face, each groove having a communication port which passes through from the first face to the second face; and a sealing plate for sealing opening faces of the grooves, wherein the sealing plate is jointed to the first face so that a plurality of pressure generating chambers are formed;

wherein the nozzle plate is jointed to the second face such that the communication holes are communicated with the nozzle orifices respectively;

wherein the liquid passage plate is comprised of coating plate material in which a metal substrate is coated by resin.

11. A liquid jetting head comprising:

a nozzle plate, provided with a plurality of nozzle orifices;

a liquid passage plate, having a first face and a second face which are opposite to each other, and provided with a plurality of first grooves which are arranged in a first direction perpendicular to a longitudinal direction of the first grooves on the first face and second grooves which are arranged next to both ends of the first grooves in the first direction, each first groove having a communication port which passes through from the first face to the second face; and a sealing plate for sealing opening faces of the first grooves and the second grooves, wherein the sealing plate is jointed to the first face so that a plurality of pressure generating chambers and dummy pressure generating chambers that have no connection with ejection of a droplet are formed;

wherein the first grooves correspond to the pressure generating chambers and the second grooves correspond to the dummy pressure generating chambers;

wherein bottom faces of the first grooves are recessed in a first shape and bottom faces of the second grooves are recessed in a second shape different from the first shape;

wherein the nozzle plate is jointed to the second face such that the communication holes are communicated with the nozzle orifices respectively.

12. The liquid jetting head as set forth in claim 11, wherein a width of the dummy pressure generating chambers in the first direction is wider than a width of the pressure generating chambers.

13. A liquid jetting head comprising:

a nozzle plate, provided with a plurality of nozzle orifices;

a liquid passage plate, having a first face and a second face which are opposite to each other, and provided with a plurality of grooves which are arranged in a first direction perpendicular to a longitudinal direction of the groove on the first face, each groove having a communication port which passes through from the first face to the second face; and a sealing plate for sealing opening faces of the grooves, wherein the sealing plate is jointed to the first face so that a plurality of pressure generating chambers are formed; and wherein the nozzle plate is jointed to the second face such that the communication holes are communicated with the nozzle orifices respectively;

further comprising a case having a joint face, the joint face provided with a concave portion;

wherein the case is jointed to the sealing plate so that a common liquid chamber communicated with the pressure generating chambers is formed by the concave portion and the sealing plate.

* * * * *